US005555462A

United States Patent [19]

Fukumoto et al.

[11] Patent Number: 5,555,462

[45] Date of Patent: Sep. 10, 1996

[54] SHEET FEEDING APPARATUS

[75] Inventors: Hiroshi Fukumoto; Naoya Tanaka, both of Amagasaki; Keisuke Oda, Fukuyama; Kazuaki Arimoto, Fukuyama; Takashi Yoshida, Fukuyama; Kazuhiko Higashi, Fukuyama; Yasunori Kasahara, Fukuyama; Terumi Kuwada, Fukuyama, all of Japan

[73] Assignee: Mitsubishi Denki Kabushiki Kaisha, Tokyo, Japan

[21] Appl. No.: 111,155

[22] Filed: Aug. 24, 1993

[30] Foreign Application Priority Data

Aug. 28, 1992 [JP] Japan ..... 4-229954
Mar. 26, 1993 [JP] Japan ..... 5-068913

[51] Int. Cl.[6] ..... B41J 11/44

[52] U.S. Cl. ..... 347/218

[58] Field of Search ..... 347/218; 346/134, 346/136; 400/582, 583.2

[56] References Cited

FOREIGN PATENT DOCUMENTS 0152873 8/1985 European Pat. Off. .
0350050 1/1990 European Pat. Off. .
0041879 3/1985 Japan .
0236779 11/1985 Japan ..... 347/218
62-95281 5/1987 Japan .
0127368 5/1989 Japan .

*Primary Examiner*—Huan H. Tran
*Attorney, Agent, or Firm*—Sughrue, Mion, Zinn, Macpeak & Seas

[57] ABSTRACT

A sheet feeding apparatus detects the position of a sheet (30) during feeding thereof and calculates a deviation of the detected sheet position relative to a reference position to thereby enable accurate color printing. A follower roller (41) for detecting a feeding amount of the sheet is in contact with the sheet which is fed by a sheet feeding roller 1, so that is rotated in accordance with the movement of the sheet. A sensor (43) generates an output signal each time the follower roller (41) rotates a predetermined angle of rotation. In one form of the invention, a timing deviation detector (51) is provided for detecting a deviation in the output timing of an output signal of the sensor relative to a reference value. In another form, a rotation angle deviation detector is provided for detecting a deviation in the rotation angle of the sheet feeding roller relative to a reference value each time the sensor generates an output signal. A feeding amount deviation calculator (52) periodically calculates a deviation in the amount of feeding of the sheet relative to a reference feeding amount based on the deviation in the output timing of the sensor output signal of based on the deviation in the rotation angle of the sheet feeding roller each time the follower roller rotates a predetermined rotation angle.

11 Claims, 26 Drawing Sheets

FIG. 18

| $\Delta Emn_{-1}, \Delta Ecn_{-1}, \Delta Ebn_{-1}$ | DRIVING PULSE REPETITION PERIOD |
|---|---|
| ⋮ | ⋮ |
| -100 | 330 |
| ⋮ | ⋮ |
| -1 | 302 |
| 0 | 300 |
| +1 | 298 |
| ⋮ | ⋮ |
| +100 | 270 |
| ⋮ | ⋮ |

FIG. 19

| $\Delta Emn_{-1}, \Delta Ecn_{-1}, \Delta Ebn_{-1}$ | PRINTING TIMING PERIOD |
|---|---|
| ⋮ | ⋮ |
| -100 | 330 |
| ⋮ | ⋮ |
| -1 | 302 |
| 0 | 300 |
| +1 | 298 |
| ⋮ | ⋮ |
| +100 | 270 |
| ⋮ | ⋮ |

SHEET FEEDING APPARATUS

BACKGROUND OF THE INVENTION

1. FIELD OF THE INVENTION

The present invention relates to a sheet feeding apparatus for feeding a sheet such as writing or manuscript paper for use in a printer, copying machine, facsimile machine, or printing machine.

2. DESCRIPTION OF THE RELATED ART

FIGS. 25–27 show a conventional sheet feeding apparatus, wherein FIG. 25 is a side view of a thermal printer, and a sheet in a thermal printer is shown in FIGS. 26 and 27 as a perspective and a side view, respectively. With reference to these figures, a sheet 30 is fed one by one from a sheet feeding mechanism 15. A leading end portion of the sheet 30 is inserted into a clamper 10, and a clamper closing mechanism (not shown) then closes the clamper 10 so as to hold the sheet 30.

A driving roller 1 (sheet-feeding driving roller) feeds a sheet and acts as a platen roller. A bridge 10*a* is provided between a pair of timing belts 3, 3 in such a manner that it is parallel to the sheet-feeding driving roller 1. The clamper 10 described above is fixed to the bridge 10*a*. A pair of first pulleys 2 are freely rotatable about the axis of the sheet-feeding driving roller 1. A pair of second pulleys 4, 4 are driven by a second motor 12 via a torque limiter 13.

With this arrangement, the timing belts 3, 3 are driven by the second pulleys 4, 4 to travel along a circulating path. Following this movement of the timing belts 3, the clamper 10 moves in the direction shown by arrow B (see FIG. 26). The running speed V2 of the clamper 10 is determined by the number of revolutions per minute N2 of the second pulleys 4, 4 which is in turn determined by the constant number of revolutions per minute M of the second motor 12 as long as no shipping occurs at the torque limiter 13.

With the arrangement described above, the clamper 10 moves passing by the first pulleys 2, 2, second pulleys 4, 4 and third pulleys 5, 5, thus returning to its starting position. During this circulating movement, the sheet 30 held by the clamper 10 is pressed against a thermal head 9 by means of the sheet-feeding driving roller 1. As a result of this, the color of an inking sheet 6 carrying color inking materials is transferred to the sheet 30.

In the case of color copying, the process is performed as follows. Assuming that the copying is done for Y (yellow) first, then M (magenta), C (cyan), and finally BK (black), first of all the leading end of the inking sheet 6 of Y is positioned, and the leading end of the sheet 30 is also positioned with the aid of a sensor PH1 which detects the leading end of the sheet. Then, the thermal head being pressed against the sheet-feeding driving roller 1, the inking sheet 6 and the sheet-feeding driving roller 1 as well as the clamper 10 are driven to move. During this process, a thermal head driver (not shown) heats the thermal head 9 according to the printing data so as to perform printing.

When printing is completed for one color, the thermal head 9 is separated from the sheet-feeding driving roller 1. Then, positioning of the leading end of the inking sheet 6 is performed for M (magenta) and printing is carried out in the same way as in the case of Y (yellow). In this printing process, the sheet 30 is circulated again passing by each of the pulley 2, 2, 4, 4, 5, and 5.

The same procedure is repeated to print the colors C (cyan) and BK (black).

During printing process for each color, the thermal head 9 is pressed against the sheet-feeding driving roller 1 via the sheet 30. Therefore, the sheet 30 is carried according to the rotation of the sheet-feeding driving roller 1 which is driven by a driving motor 11. In other words, the sheet 30 is carried at a constant speed V1 which is determined by the rotational speed of the sheet-feeding driving roller 1. As a result, the clamper 10 holding the sheet 30 also runs at the same speed V1.

While this clamper running speed V1 represents the running speed of the sheet 30 and the clamper 10 during the printing process, the previously described clamper running speed V2 represents the speed when no printing process is performed. The clamper running speed V2 is set to a value faster than the sheet running speed V1. The difference in speed between V1 and V2 is absorbed by slipping of the torque limiter 13. This slipping occurs such that a predetermined magnitude of torque determined by the torque limiter 13 is applied to the clamper 10 via the second pulleys 4, 4, and the timing belts 3, 3. This means that during the printing process, the clamper 10 pulls the sheet 30 with a tension of a predetermined value.

In such a sheet feeding apparatus for a thermal printer described above, the sensor PH1 disposed in a sheet feeding path detects the sheet feeding condition. When the sensor PM1 detects that the sheet 30 has arrived at the starting position of printing, the thermal heads 9 starts printing. However, even if the starting position is given accurately, is difficult to perform accurate printing at desired positions along the whole length of a sheet.

This problem occurs because of the fluctuation of the tension applied to the sheet 30 which results from the fluctuation of torque of the torque limiter 13, tension of the inking sheet 6, and the coefficient of friction of the sheet-feeding driving roller 1. That is to say, when the sheet 30 is bitten by or fed between the sheet-feeding driving roller 1 and the thermal head 9 at their contacting position, and the sheet 30 is carried according to the rotation of the sheet-feeding driving roller 1, there may occur slight slippage between the sheet 30 and the sheet-feeding driving roller 1 due to a difference in the sheet tension between the areas before and after the sheet-feeding driving roller 1, and due to the fact that the amount of the slippage changes depending on a change in the tension applied to the sheet 30.

In the case of high density printing for the whole sheet, the temperature of the sheet-feeding driving roller rises, which results in an increase in the diameter of the sheet-feeding driving roller 1, which further results in an increase in the sheet feeding length.

In particular, in the case of color printing, if the above phenomena introduce variations of printing positions between each color to be composited together, degradation of printing quality occurs due to the registration error between different colors.

In a region near the starting position, it is possible to achieve small registration errors between each of colors less than a maximum tolerance, because the positioning of the starting point of each color can be done accurately enough as described earlier.

However, the error in the amount of feeding of the sheet is accumulated and the error can become large in the area near the trailing end thereof, thus noticeably large registration errors between colors may appear. In particular, in the case of a large-sized sheet such as a standard A3 size or larger, it is difficult to achieve small registration errors between colors less than a maximum tolerance along the whole sheet.

The problem described above occurs because the positioning of the sheet 30 is carried out only at the leading end thereof when feeding operation starts and because the position of the sheet 30 during the feeding process cannot be detected. If the position of the sheet can be detected during the feeding process and if a deviation of the sheet position from the reference position can be determined, then it becomes possible to correct the printing position or the amount of feeding. Therefore, the most important issue is to detect the position of the sheet during the feeding process.

In general, rubber is used as a material forming the surface of the sheet-feeding driving roller 1. Aging of the rubber results in another problem that the printing length changes due to variations in the diameter of the sheet-feeding driving roller 1.

SUMMARY OF THE INVENTION

In view of the above, it is an object of the present invention to provide a sheet feeding apparatus which is capable of detecting the sheet position as well as calculating a deviation thereof from the reference position.

According to one aspect of the present invention, there is provided a sheet feeding apparatus comprising: sheet feeding means being rotatable for feeding a sheet; follower roller means being in contact with the sheet fed by the sheet feeding means for detecting a feeding amount of the sheet, the follower roller means being rotated in accordance with the movement of the sheet; sensor means for generating a signal each time the follower roller means rotates a predetermined angle; timing deviation detecting means for detecting a deviation in the output timing of an output signal of the sensor means relative to a reference value; and feeding amount deviation calculating means for periodically calculating a deviation in the amount of feeding of the sheet relative to a reference feeding amount based on the deviation in the output timing of the sensor output signal each time the follower roller means rotates a predetermined angle of rotation.

With this arrangement, it is possible to detect the deviation of the sheet position occurring during the sheet feeding operation at the timing of every rotation of a predetermined angle of the follower roller means which is in contact with the sheet. Thus, it is possible to successively detect the position of the moving sheet and accurately calculate the deviation of the sheet position from the reference position.

According to another aspect of the invention, there is provided a sheet feeding apparatus comprising: sheet feeding means being rotatable for feeding a sheet; follower roller means being in contact with the sheet fed by the sheet feeding means for detecting a feeding amount of the sheet, the follower roller means being rotated in accordance with the movement of the sheet; sensor means for generating a signal each time the follower roller means rotates a predetermined angle; rotation angle deviation detecting means for detecting a deviation in the rotation angle of the sheet feeding means relative to a reference value each time the sensor means generates an output signal; and feeding amount deviation calculating means for periodically calculating a deviation in the amount of feeding of the sheet relative to a reference feeding amount based on the deviation in the rotation angle of the sheet feeding means each time the follower roller means rotates a predetermined rotation angle.

It is preferred that the deviation of the feeding amount of the sheet relative to the reference value be calculated every n revolutions of the follower roller means, the n being a natural number. This serves to reduce the influence of the nonuniformity of the pitch of marks which are provided on the follower roller means, and/or the influence of decentering of the follower roller means.

In one form of the invention, there is provided means for adjusting a starting point of the follower roller means each time a sheet is supplied to the sheet feeding means. This serves to improve a sheet-to-sheet variation in the detected amount of the sheet feeding which results from small variations in the tension and/or the coefficient of friction depending on the sheet position.

in a preferred form, the follower roller means comprises a plurality of follower rollers disposed in the direction perpendicular to the direction of feeding of the sheet, and the sensor means comprises a plurality of sensors provided one for each of the follower rollers for generating a signal each time a corresponding one of the follower rollers rotates a predetermined angle.

In a further form, there is provided means for controlling the sheet feeding means based on the information on the deviation of the feeding amount of the sheet relative to the reference value to compensate for the feeding amount of the sheet in such a manner that each of printing lengths of colors M, C, and BK is adjusted to a printing length of color Y. If this arrangement is used for printing, it is possible to realize high quality printing with no registration errors between colors M, C, BK even in large-sized sheets. It is also possible to reduce the effects of aging of the sheet feeding means, the follower roller means and the like on a change in the printing length.

In a still further form, there is provided means for controlling the sheet feeding means based on the information on the deviation of the feeding amount of the sheet relative to the reference value to compensate for the feeding amount of the sheet in such a manner that the printing length of each color is adjusted to a reference printing length.

In a further form, there is provided means for controlling a printing strobe generation means based on the information on the deviation of the feeding amount of the sheet relative to the reference value to control the printing timing in such a manner that each of the printing lengths of colors M, C, and BK is adjusted to a printing length of color Y.

In a further form, there is provided means for controlling a printing strobe generation means based on the information on the deviation of the feeding amount of the sheet relative to the reference value to control the printing timing in such a manner that the printing length of each color is adjusted to a reference printing length.

In a further form, there is provided calculation means for determining the deviation of the feeding amount of the sheet relative to the reference value by using motor driving pulses instead of a reference clock.

The above and other objects, features and advantages of the present invention will become more readily apparent from the following detailed description of preferred embodiments thereof taken in conjunction with the accompanying drawings.

BRIEF DESCRIPTION OF THE DRAWINGS

FIG. 18 shows a compensation table for use in the sixth embodiment of the present invention;

FIG. 19 shows a compensation table for use in an eighth embodiment of the present invention;

DESCRIPTION OF THE PREFERRED EMBODIMENTS

Figure 1:
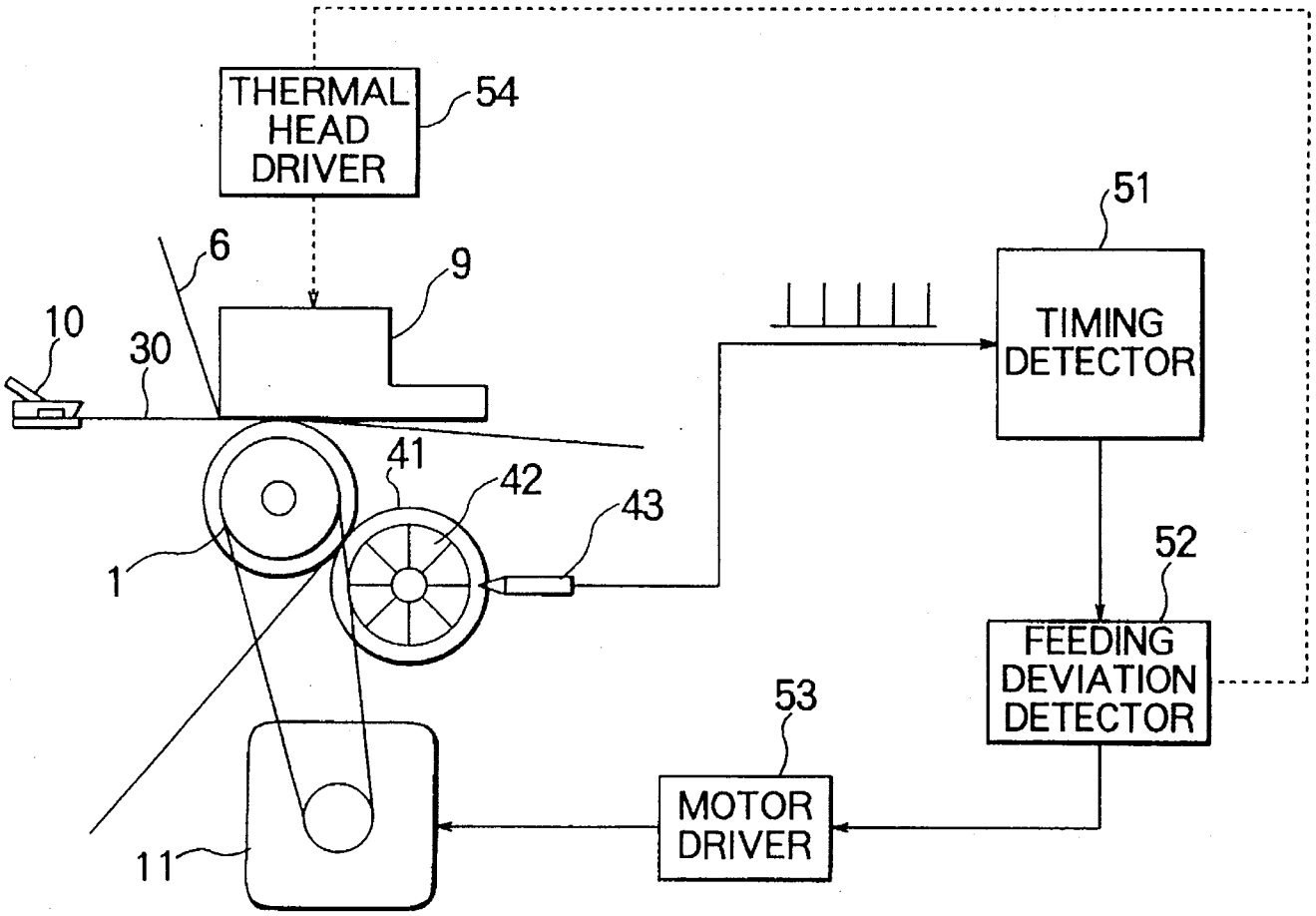
FIG. 1 shows the configuration of a sheet feeding apparatus in accordance with a first embodiment of the present invention, in which only main parts are shown.
Figure 25:
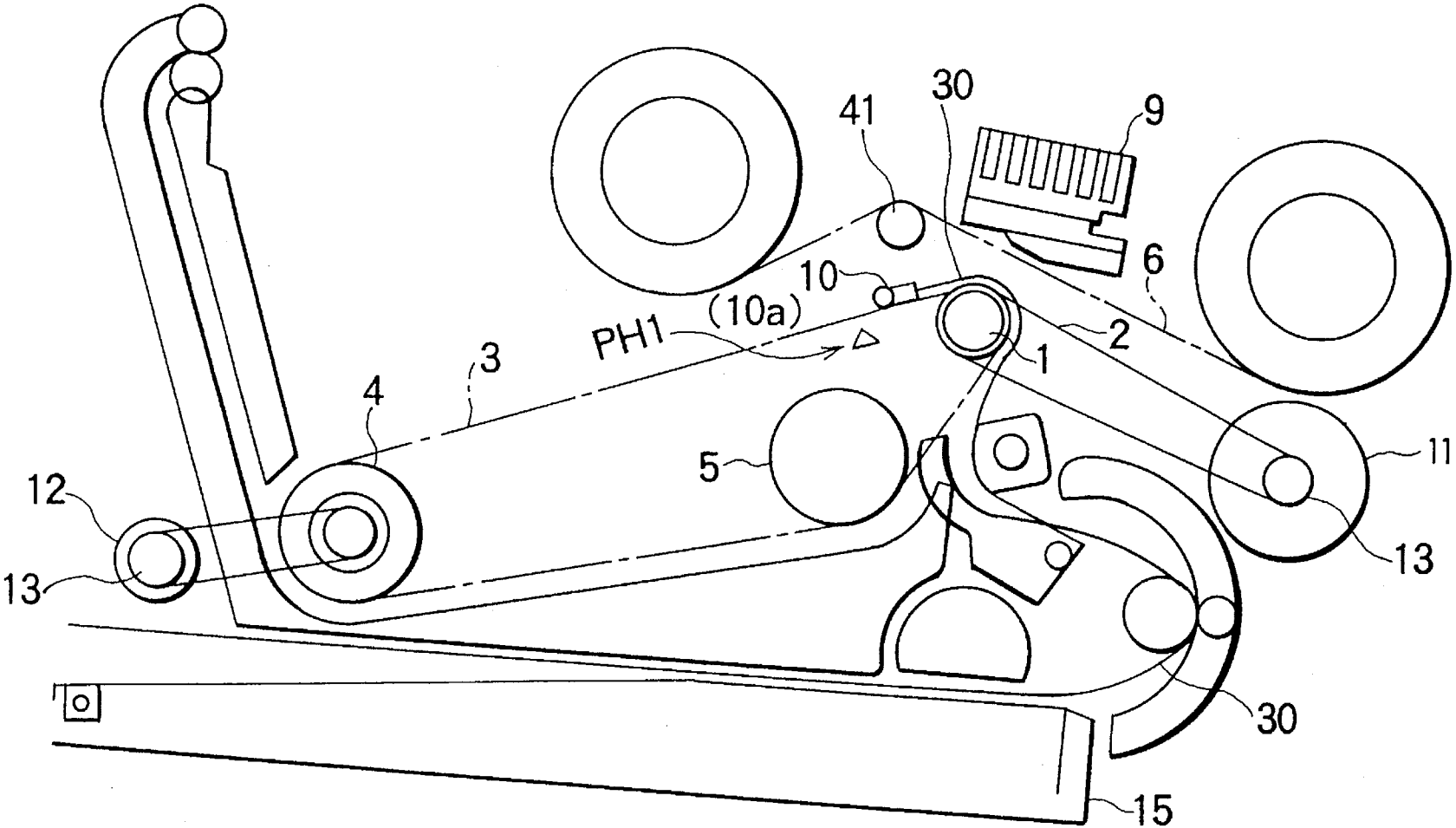
FIG. 25 PRIOR ART
FIG. 25 is a side view of a conventional sheet feeding apparatus used in a thermal printer.
Figure 26:
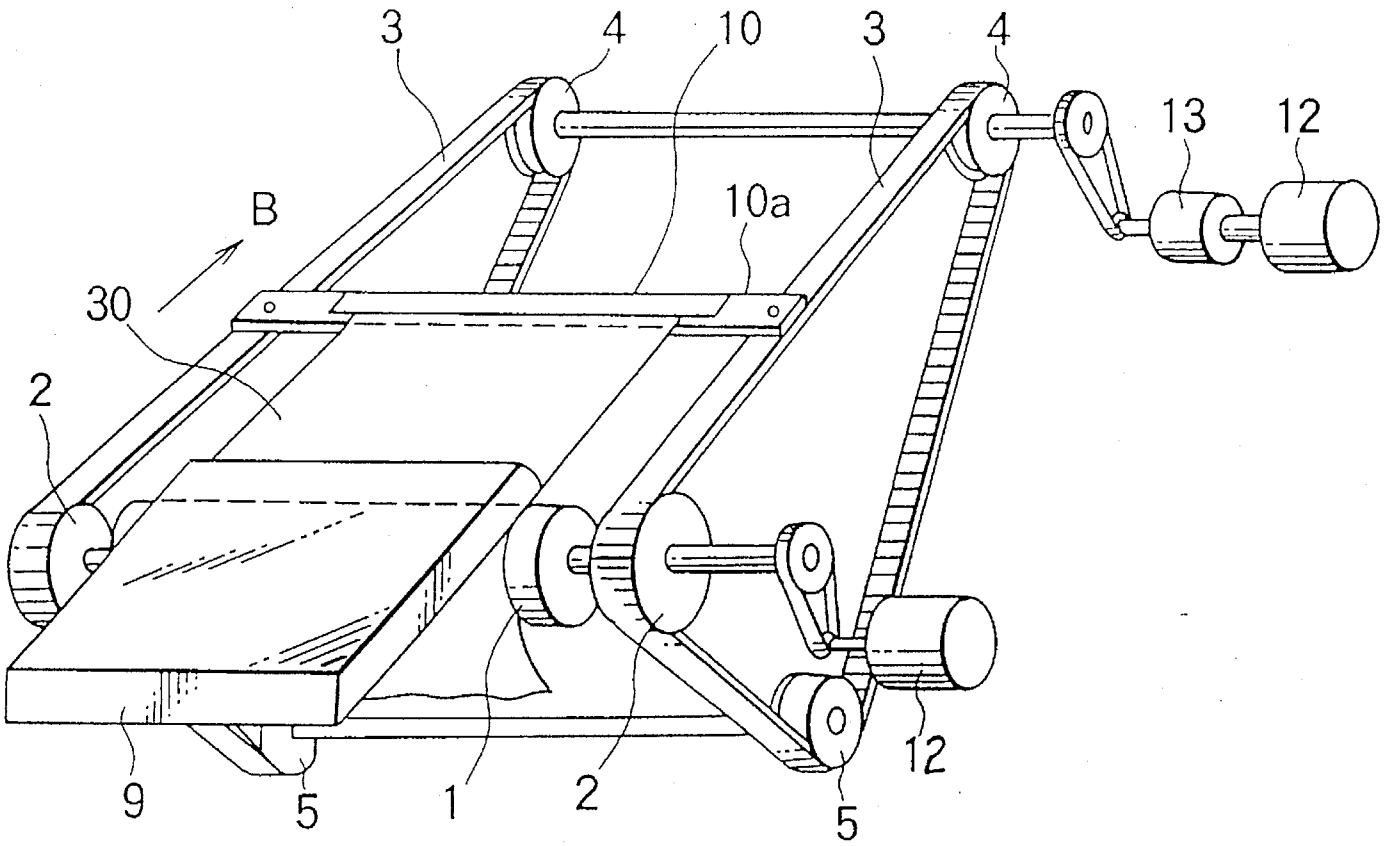
FIG. 26 PRIOR ART
FIG. 26 is a perspective view for illustration of feeding of a sheet in a conventional thermal printer.
Figure 27:
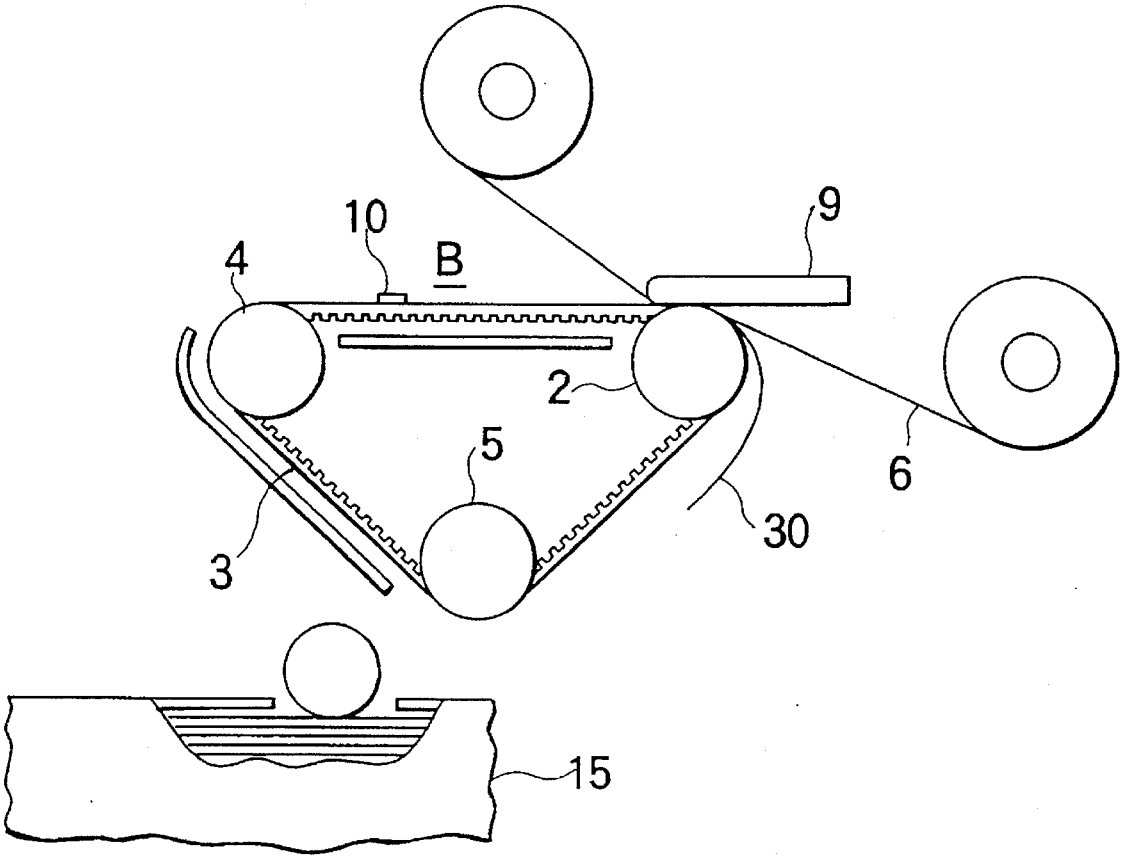
FIG. 27 PRIOR ART
FIG. 27 is a side view for illustration of feeding of a sheet in a conventional thermal printer.

FIG. 1 shows a configuration of a sheet feeding apparatus in accordance with a first embodiment of the present invention, illustrating only main parts of the apparatus. The elements similar to those shown in FIGS. 25–27 are denoted at the same symbols as those used in FIGS. 25–27 and the explanation on these elements will not be repeated again hereinbelow. With reference to FIG. 1, the leading end portion of a sheet 30 is held by a clamper 10, and the sheet 20 is driven to move by the rotation of a sheet-feeding driving roller 1. The clamper 10 pulls the sheet 30 with a predetermined tension so as to carry the sheet 30 along a circulating path.

The sheet 30 is pressed against the sheet-feeding driving roller 1 by a follower roller 41 for detecting the position of the traveling sheet so that the sheet 30 is wound around the sheet-feeding driving roller 1 without a slag. Thus, the follower roller 41 rotates following the movement of the sheet 30. A disk 42 is attached to the end of the axis of the follower roller 41. Marks are disposed on the disk 42 at a fixed interval in the circumferential direction. When each mark passes by a mark sensor 43, the mark sensor outputs a pulse signal.

The pulse signal given by the mark sensor 43 each time the follower roller 41 rotates by a predetermined fixed angle is provided to a timing detector 51, then the timing detector 51 detects the deviation of the timing of the pulse relative to the reference timing. This detected deviation of timing is converted to a deviation in the feeding amount of a sheet by a feed deviation calculator 52. Based on the thus obtained information on the deviation of the feeding amount, a thermal head driver 54 and/or a motor driver 53 are controlled so as to correct the printing position and/or the feeding amount of a sheet.

In advance, the reference timing value is determined from the sheet feeding speed and the interval between marks and the obtained timing reference is stored in the timing detector 51. The output signal timing of the mark sensor 43 is obtained by counting the reference clock pulses.

Now, the principle of detecting the deviation of the feeding amount of a sheet will be described hereinbelow.

When the sheet 30 travels driven by the sheet-feeding driving roller 1, a small amount of slipping occurs between the sheet and the sheet-feeding driving roller 1 due to the variations of the tension introduced in the sheet 30 and/or due to the variations of the coefficient of friction. As a result, the feeding amount of the sheet does not always correspond to the rotational amount of the sheet-feeding driving roller 1. On the other hand, the rotational amount of the follower roller 41 corresponds to the feeding amount of the sheet 30 with sufficiently good accuracy. This is because there is no force introduced in the sheet traveling direction at the point where the sheet is in contact with the follower roller 41.

Figure 2:
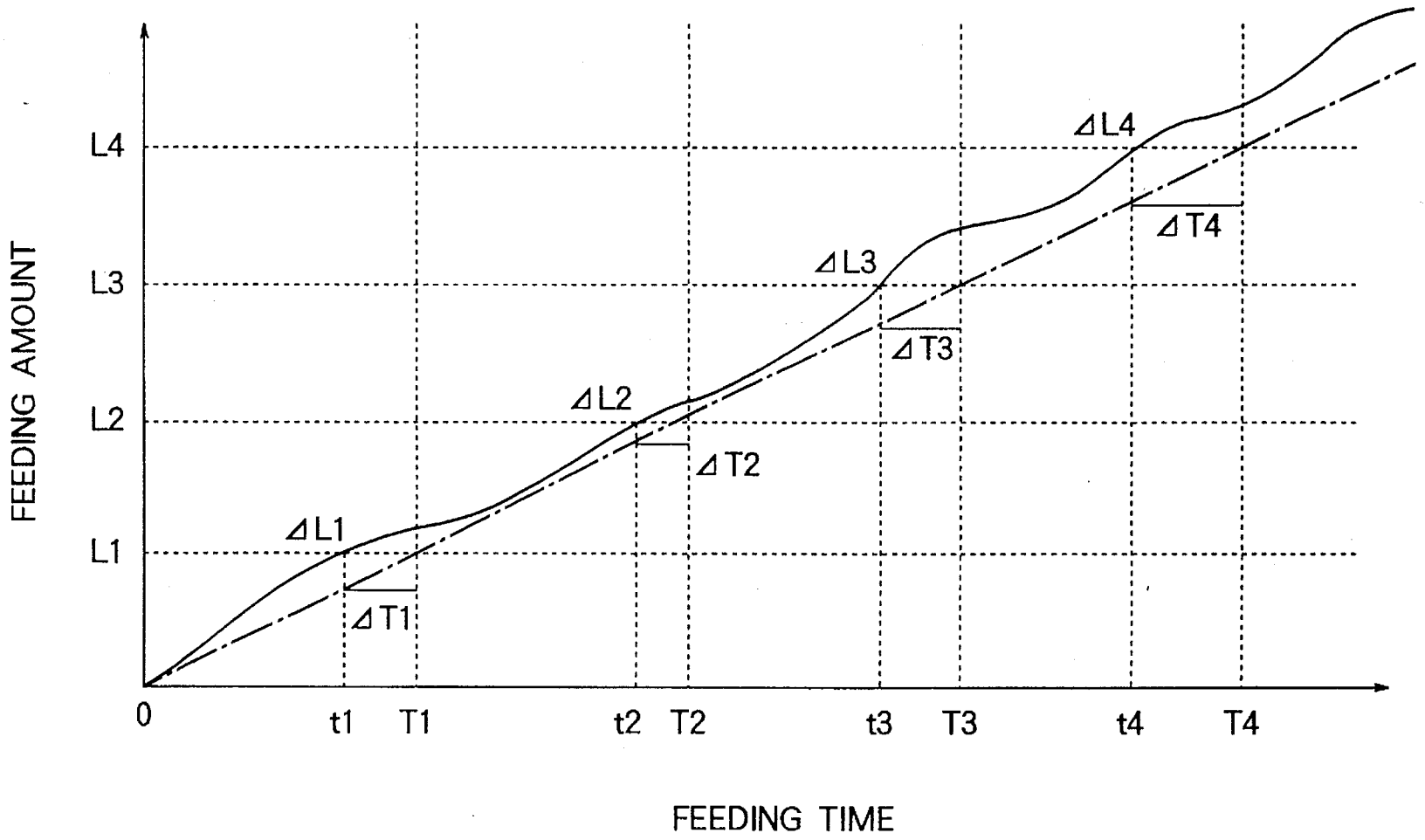
FIG. 2 illustrates the principle of the first embodiment of the present invention.

FIG. 2 is a graph showing the relation between the feeding amount of a sheet and the feeding time. The line broken by a dot (broken line) represents the reference value which increases with time. The slope V of this broken line represents the reference feeding speed. The solid line represents an example of an actual relationship showing that the actual values increasingly deviate from the reference values with time. this figure, marks L1, L2, L3, and L4 denote the feeding amounts detected when the output signals are provided from the mark sensor 43. These feeding amounts L1–L4 correspond to the feeding amounts obtained every rotation of a predetermined angle of the follower roller 41. T1, TZ, T3, and T4 denote the reference timing values of the output signal of the mark sensor 43, which have values with the fixed intervals corresponding to L1, L2, t3, and L4, respectively.

As shown in FIG. 2, the times required to actually feed the sheet by the amounts denoted by L1, L2, t3, and L4 are t1, t2, t3, and t4, respectively. Thus, the timing deviations Δt1, ΔT2, ΔT3, and ΔT4 are detected. By multiplying each of these timing deviations by the reference feeding speed V, it possible to calculate the deviations ΔL1, ΔL2, ΔL3, and ΔL4 of the feeding amounts corresponding to every rotation of a predetermined fixed angle of the follower roller 41. FIG. 2 shows the state for only the duration from the starting of the feeding to the time when the fourth signal has been output from the mark sensor 43. However, in practice, the deviations of the feeding amounts are detected in the same manner until the feeding is completed.

Figure 3:
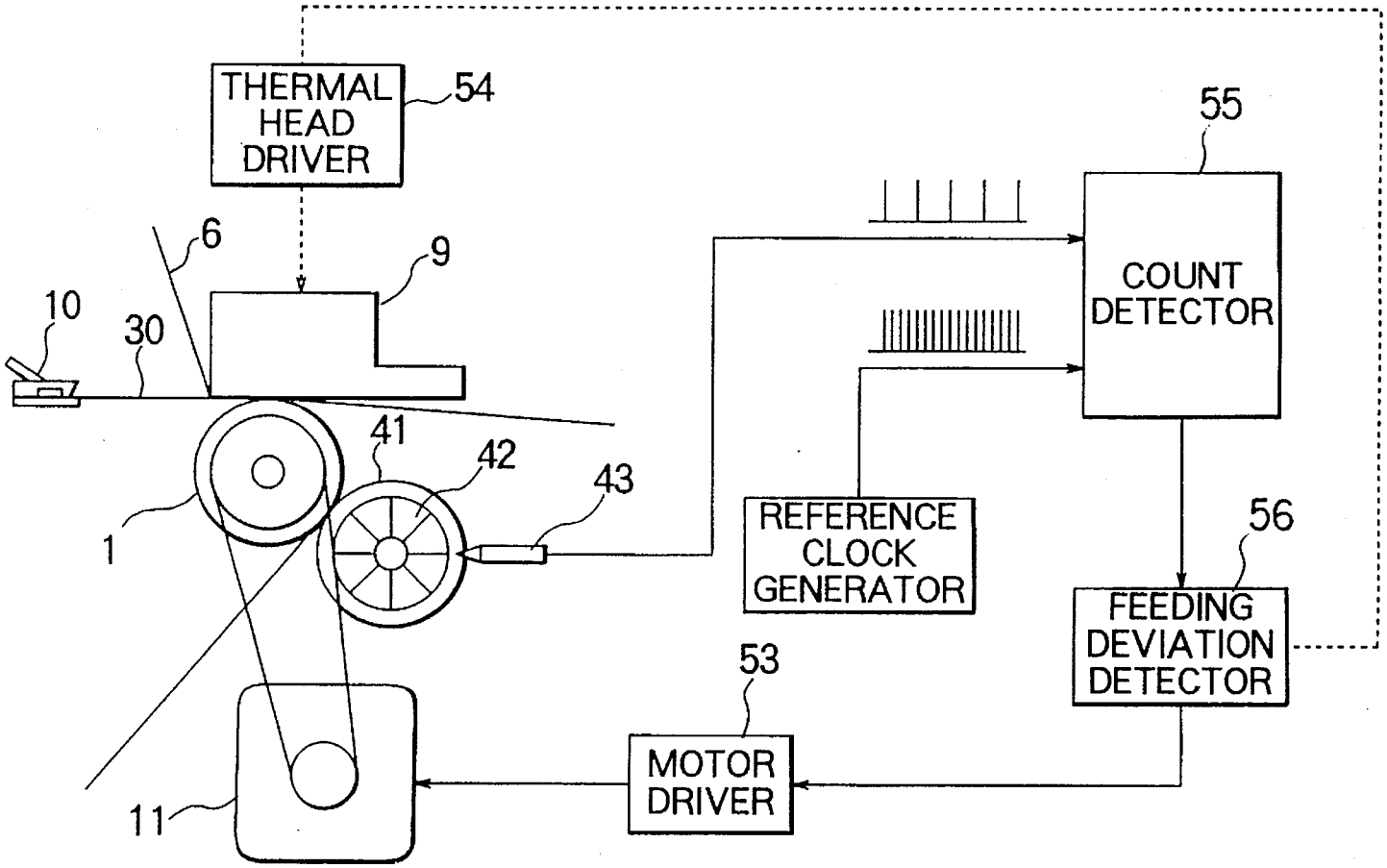
FIG. 3 shows the configuration of a sheet feeding apparatus in accordance with the second embodiment of the present invention, in which only main parts are shown.

FIG. 3 shows a configuration of a sheet feeding apparatus in accordance with a second embodiment of the present invention, illustrating only main parts of the apparatus.

As in the first embodiment, the follower roller 41 presses the sheet 30 against the sheet-feeding driving roller 1 so that the sheet 30 is wound around the sheet-feeding driving roller 1 with no sag. Thus, the follower roller 41 rotates following the movement of the sheet 30. A disk 42 is attached to the end of the axis of the follower roller 41. Marks are disposed on the disk 42 at a fixed interval in the circumferential direction. When each mark passes by a mark sensor 43, the mark sensor outputs a pulse signal.

In this second embodiment, each time the follower roller 41 rotates by a predetermined fixed angle and the mark sensor 43 outputs the pulse signal, the deviation of the counting number of the reference pulses relative to the reference number is detected by a counting detector 55. Then, this detected deviation of timing is converted to a corresponding deviation of the feeding amount by a feeding deviation calculator 56. Based on the thus obtained information on the deviation of the feeding amount, a thermal head driver 54 and/or a motor driver 53 are controlled so as to correct the printing position and/or the feeding amount. In advance, the reference counting number is determined from the reference feeding amount per one driving pulse and the interval between marks and the determined reference counting number are stored in the counting detector 55.

Figure 4:
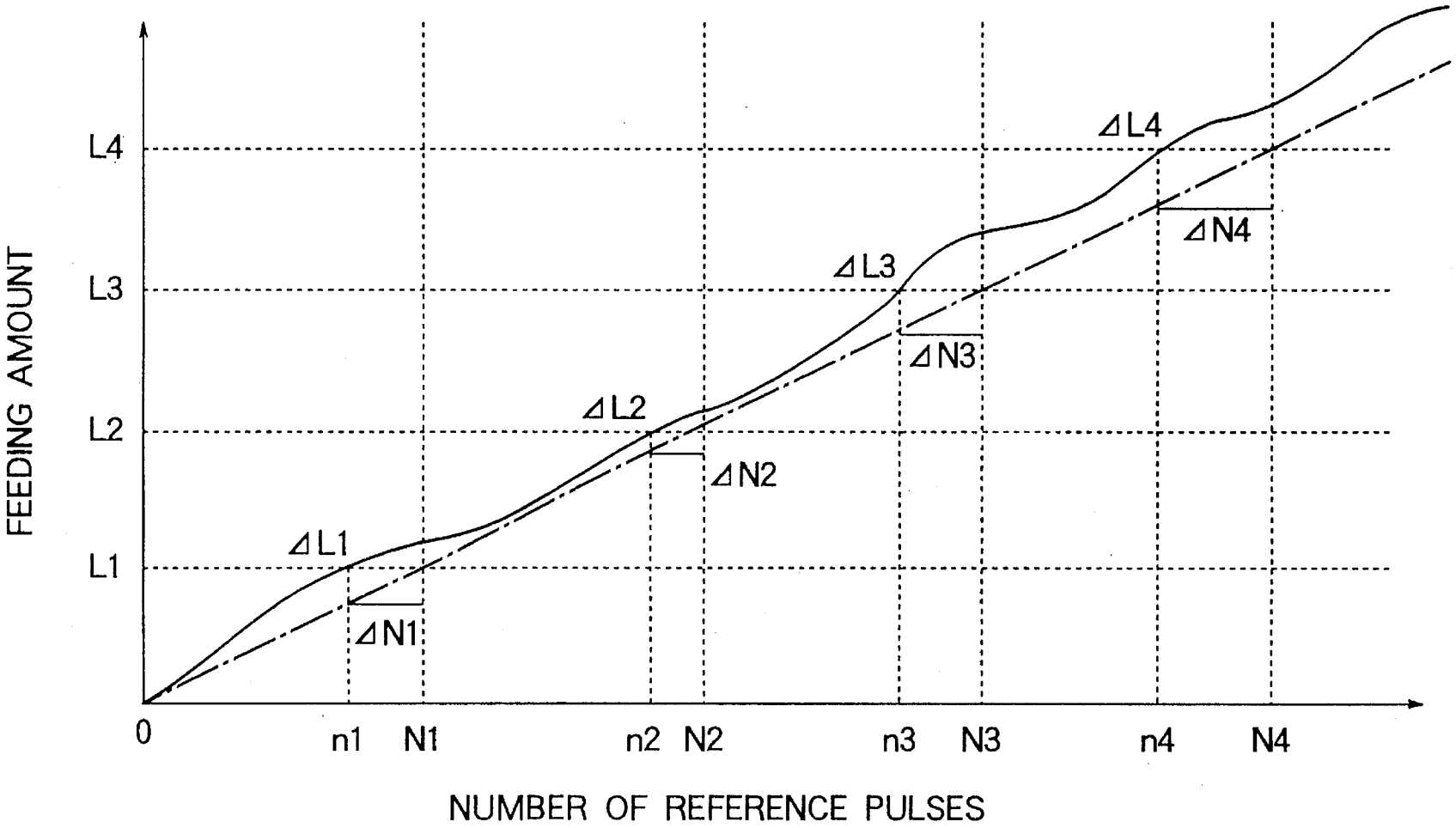
FIG. 4 illustrates the principle of the second embodiment of the present invention.

FIG. 4 is a graph showing the feeding amount of a sheet as a function of the number of the reference pulses. The line broken by a dot (broken line) represents the reference feeding amount which increases with the number of the reference pulses. The slope D of this broken line represents the reference feeding amount per one reference pulse. The solid line represents an example of actual feeding amounts, in which it is observed that the deviation of the actual value relative to the reference value expands gradually. In this figure, marks L1, L2, L3, and L4 denote the feeding amounts at the times when the output signals are provided from the mark sensor 43. These feeding amounts L1–L4 correspond to those obtained every rotation of a predetermined fixed angle of the follower roller 41. N1, N2, N3, and N4 denote the reference numbers of the pulses at the times when the output signals are provided from the mark sensor 43, which have constant stepping values corresponding to L1, L2, L3, and L4, respectively.

As shown in FIG. 4, the reference numbers of pulses required to actually feed the sheet by the amounts denoted by L1, L2, L3, and L4 are n1, n2, n3, and n4, respectively. Thus, the deviations of the counting numbers ΔN1, ΔN2, ΔN3, and/ΔN4 are detected. By multiplying each of these deviations of the counting numbers by the reference feeding amount per one reference pulse speed D, it is possible to calculate the deviations ΔL1, ΔL2, ΔL3, and ΔL4 of the feeding amounts corresponding to every rotation of a predetermined fixed angle of the follower roller 41. FIG. 2 shows the state for only the duration from the starting of the feeding to the time when the fourth signal has been output from the mark sensor 43. However, in practice, the deviations of the feeding amounts are detected in the same manner until the feeding is completed.

In this embodiment, the reference pulse is used to determine the reference feeding amount. Alternative arrangement may be such that an encoder is attached to the axis of the driving motor 11 or the sheet-feeding driving roller 1 and the output pulses from the encoder are used for the same purpose.

In the above mentioned first and second embodiments, the deviation of the feeding amount is detected each time the mark sensor 43 provides the output signal. As a result, it is impossible to detect the deviation of the feeding amount during the intervals between these output signals provided from the mark sensor 43. Therefore, depending on the tolerable deviation and/or the accuracy of the feeding mechanism itself, it is desired to design the pitch of the marks provided on the disk 42 which determines the intervals of the output signals from the mark sensor 43. That is to say, in the case where the accuracy of the feeding mechanism itself is low, or in the case where the tolerable deviation is small, it is required that the detection period is short enough so as to frequently make compensation. Thus, the pitch of the marks should be set to small value. 0n the contrary, in the case where the accuracy of the feeding mechanism itself is high, or in the case where large deviations are tolerable, it is possible to set the pitch of the marks to a large value.

Figure 5:
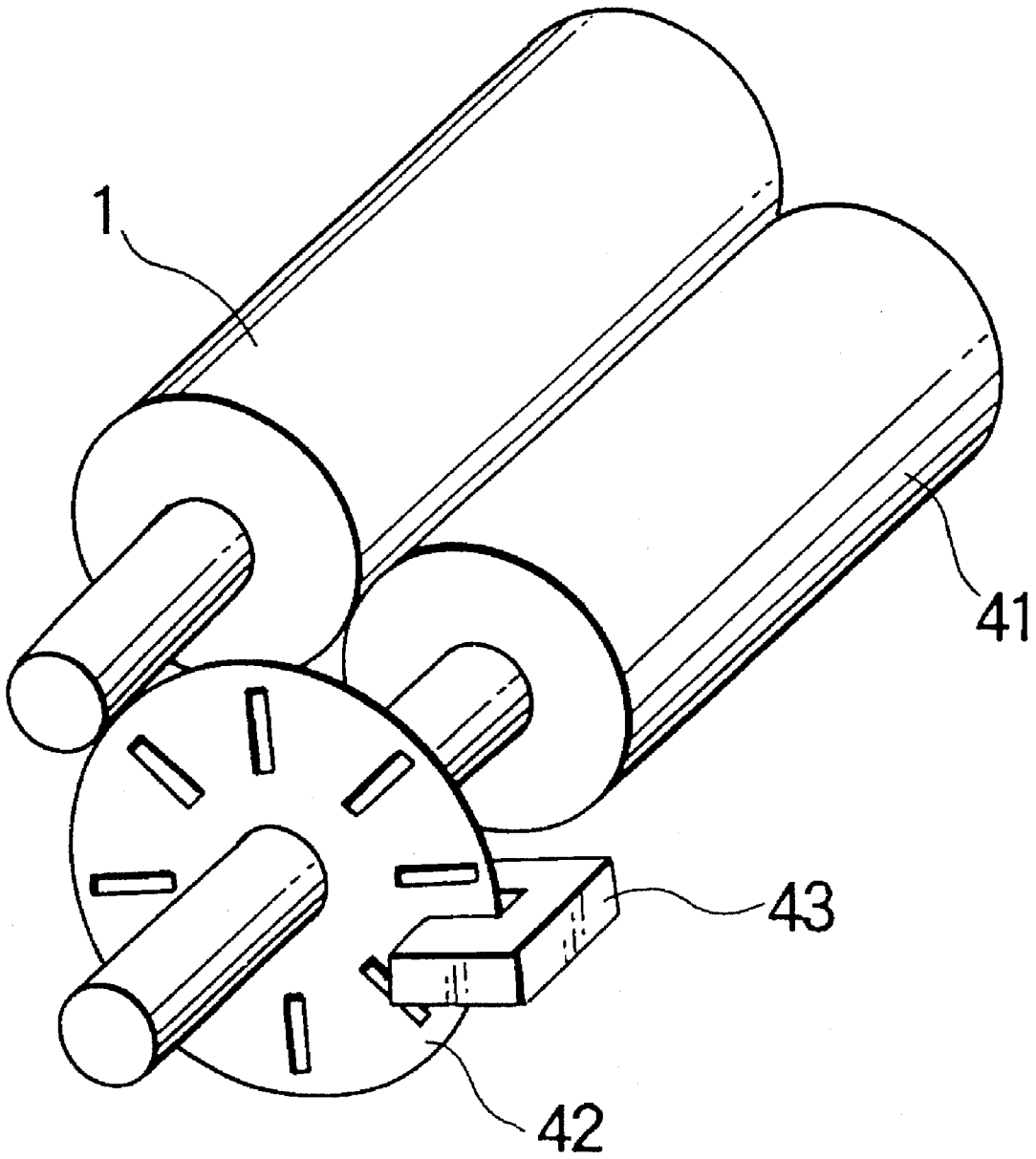
FIG. 5 is an enlarged perspective view of main parts associated with another mode of the first and second embodiments of the present invention.

In the first and second embodiments, the mark sensor 43 uses a reflection type of optical sensing system to detect the marks on the disks 42. Alternatively, as shown in FIG. 5, a transmission type optical system may be used in which slits are provided in the disk 12 at fixed intervals and these slits are used as the marks to be detected. Further alternatively, any other mechanical or electrical contact type sensor may be used as long as it can output a signal every rotation of a constant angle of the follower roller 41.

Figure 6:
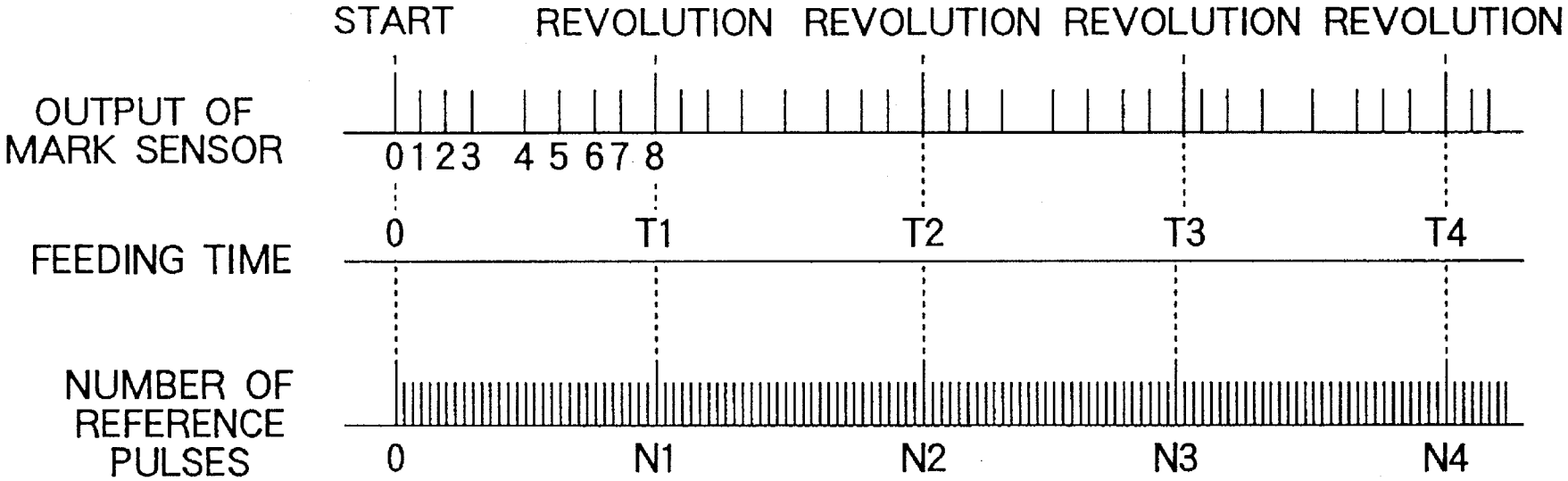
FIG. 6 illustrates the principle of a third embodiment of the present invention.

Now, a third embodiment will be described hereinbelow. The third embodiment is obtained by modifying the above mentioned first and second embodiments in such a way that the detection of the deviation of the feeding amount is performed every one rotation (360°) of the follower roller 41. FIG. 6 is a timing chart showing the output signal of the mark sensor 43 and the reference pulses.

When there exists nonuniformity of the pitch of the marks provided on the disk 42 and/or decentering of the follower roller 41, even if the sheet 30 is fed by exactly the same amount as the reference feeding amount, the intervals of the output signals from the mark detecting sensor 43 becomes nonuniform which leads to the detection errors of the deviation of the feeding amount. This nonuniformity occurs with a period of one revolution of the follower roller 41.

Therefore, if the detection of the deviation of the feeding amount is carried out once every one revolution of the follower roller 41, then it becomes possible to reduce the influence of the nonuniformity of the pitch of the marks provided on the disk 42 and decentering of the follower roller 41.

More specifically, as shown in FIG. 6, if the total number of the marks along one whole revolution of the follower roller 41 is denoted by m (m=8 in the case of FIG. 6), the timing detector 51 or the counting detector 55 performs the detecting operation associated with the timing deviation or counting deviation, every m counts of the output signal of the mark sensor 43.

The time intervals between each calculation of the deviation of the feeding amount of a sheet relative to the reference value is not limited to once every one revolution of the follower roller 41. The calculation of the deviation of the feeding amount may be carried out every n (n is a natural number) revolutions of the follower roller 41 to obtain the same effect.

Figure 7:
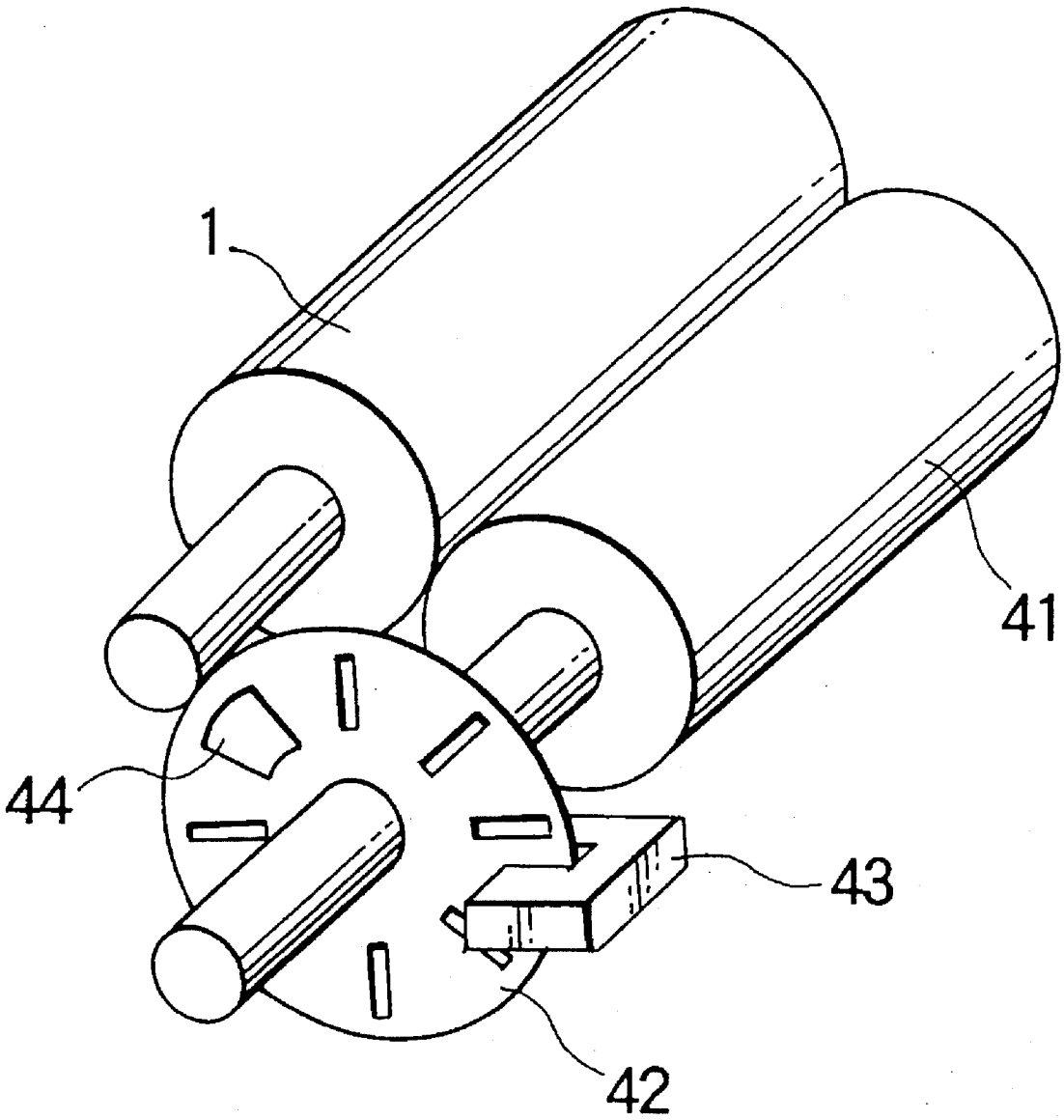
FIG. 7 is a perspective view showing the configuration of a fourth embodiment in accordance with the present invention, in which only main parts are shown.

Now, a fourth embodiment will be described hereinbelow. In this fourth embodiment, in addition to the arrangement of the above mentioned first and second embodiments, it is further arranged to adjust the starting point of the follower roller 41 each time a sheet is fed. As shown in FIG. 7, the width of one of marks provided on the disk 42 is made different from that of the other marks, and this special mark is used as a starting mark 44. The mark detecting sensor 43 distinguishes this starting mark 44 from the other marks by detecting the difference in pulse widths of the sensed signals.

To adjust the starting point of the follower roller 41, the sheet-feeding driving roller 1 is pressed against the follower roller 41 just before a sheet is begun to be fed. Then, the sheet-feeding driving roller 1 is driven by the driving motor 11 so as to rotate the follower roller 41 with the friction between the sheet-feeding driving roller 1 and the follower roller 41. When the starting mark 44 is detected, the driving of the sheet-feeding driving roller 1 is stopped and the sheet-feeding driving roller 1 is removed from the follower roller 41. After that, the operation starts to feed a sheet.

Figure 8:
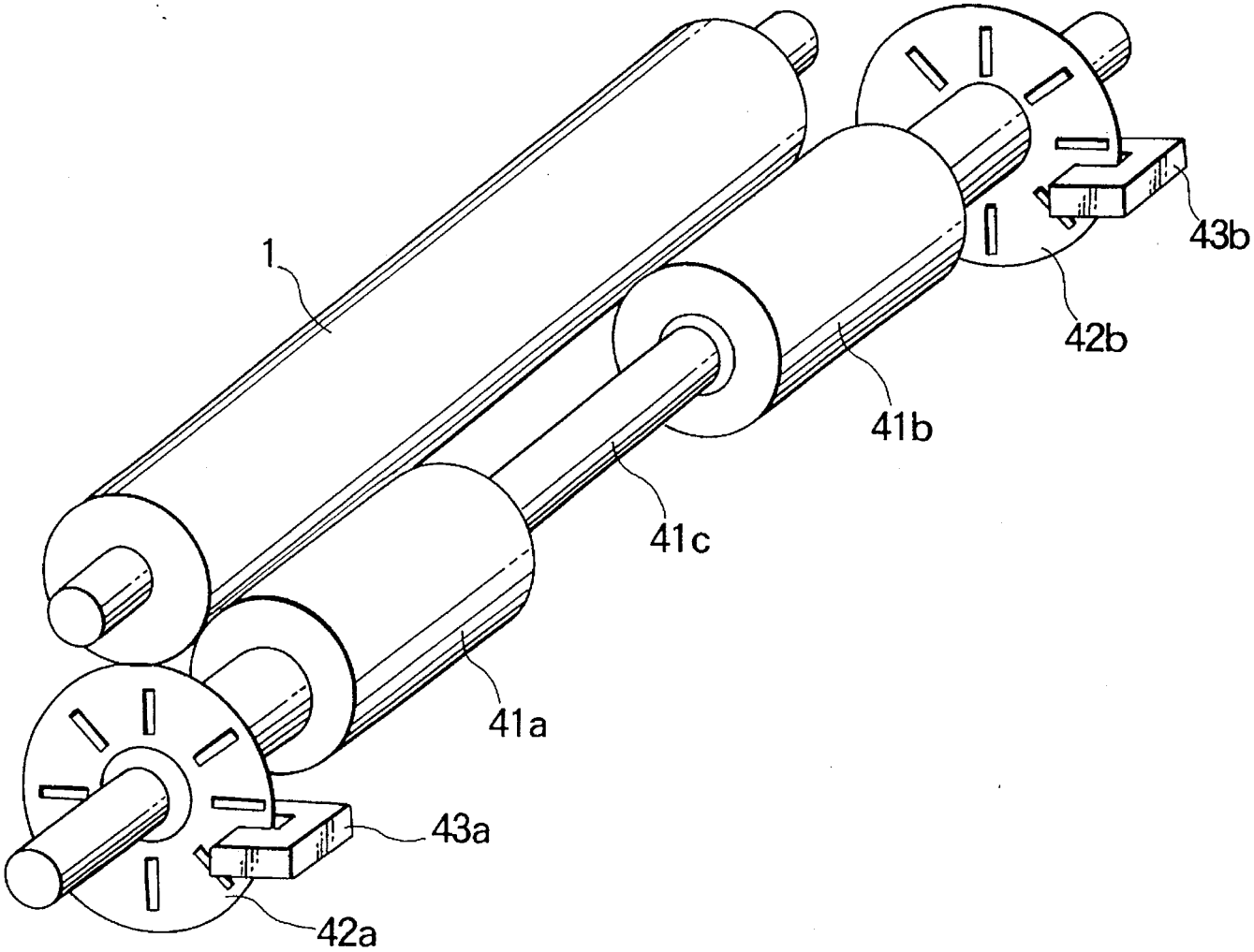
FIG. 8 is a perspective view showing the configuration of a fifth embodiment in accordance with the present invention, in which only main parts are shown.

FIG. 8 is a perspective view of a sheet feeding apparatus in accordance with a fifth embodiment of the present invention, showing the configuration of only the main portions. In this embodiment, two follower rollers 41*a* and 41*b* are disposed in the direction perpendicular to the feeding direction of the sheet 30 in such a way that these follower rollers 41*a* and 41*b* can rotate around the shaft 41*c* independently of each other. The rotation of the follower roller 41*a* and 41*b* is detected by mark sensors 43*a* and 43*b* with the aid of separate disks 42*a* and 42*b*.

The detected signals from the mark sensors 43*a* and 43*b* are applied to separate feed deviation detectors 52. With this arrangement, the deviation of the feeding amount of a sheet 30 in the rotational direction is detected from the difference in the deviation of the feeding amount between two positions which are apart from each other in the direction of the width of the sheet 30. Based on the information on this deviation of the feeding amount, a thermal bead driver 54 and/or a motor driver 53 are controlled so as to compensate for the printing position and/or the feeding amount.

In the first through fifth embodiments, in particular in the case where a sheet 30 is carried a number of times to the printing unit consisting of the thermal head 9 so as to perform composite printing as in color printing, when the first-time printing is carried out, the timing of output signals of the mark sensor 43 or the counted number of the driving pulses is stored without performing the compensation of the printing positions and/or the feeding amount. Then, in the second-time printing or in the printing after that, the stored values are used as the reference values to detect the deviations of the feeding amounts. Furthermore, compensation of the printing positions or the feeding amount is carried out, thus the reduction in the registration errors between colors can be achieved.

In each embodiment described above, the sheet feeding apparatus is used for printing. However, the apparatus may also be used in other applications in which it is required to monitor the feeding amount of a sheet or to make a warning sound depending on the deviation of the feeding amount.

Figure 9:
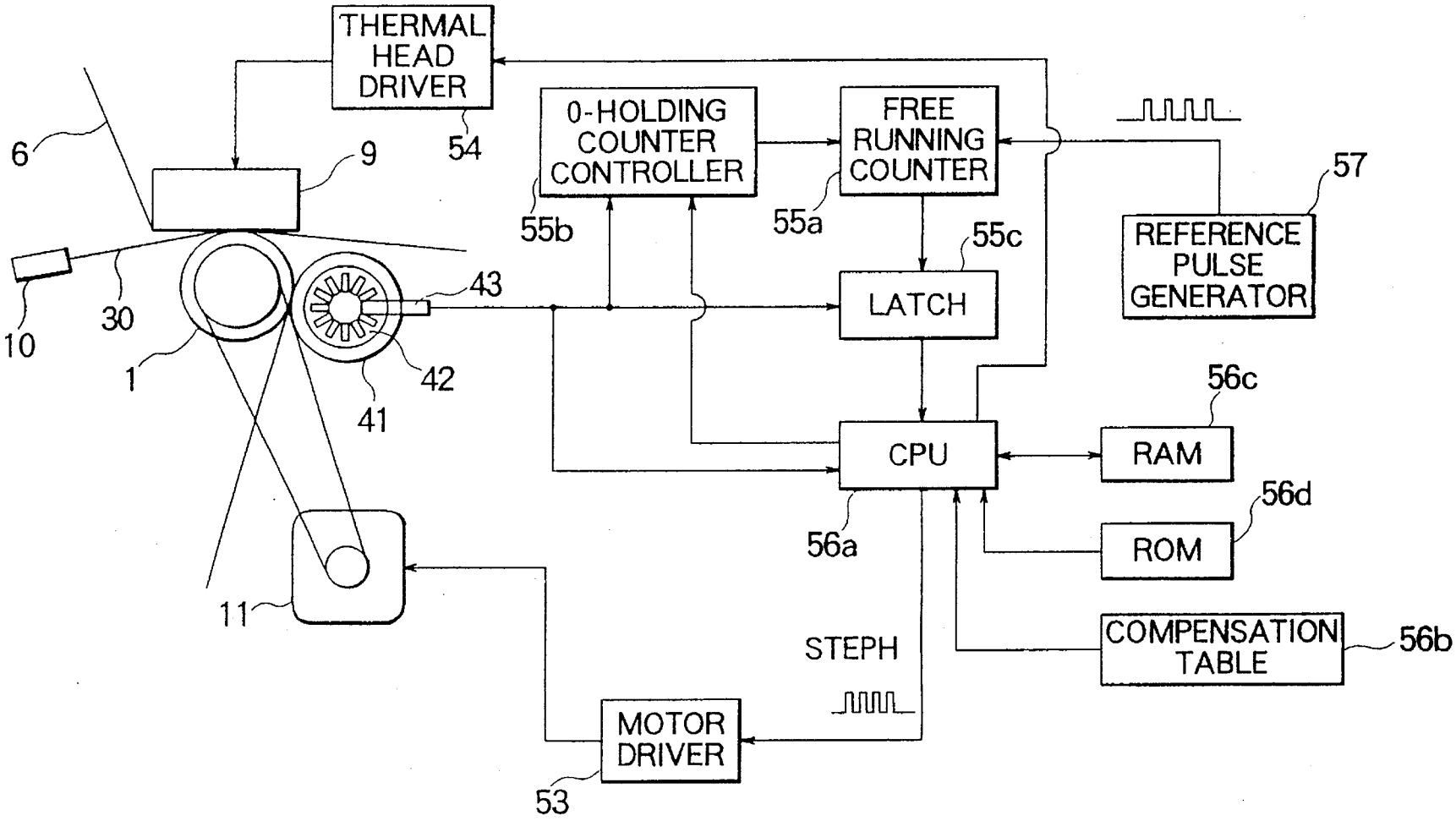
FIG. 9 shows the configuration of a sixth embodiment in accordance with the present invention, in which only main parts are shown.

FIG. 9 shows a sheet feeding apparatus in accordance with a sixth embodiment of the present invention, in which only major parts are shown. With reference to FIG. 9, a reference pulse generator 57 generate reference pulses which are used to measure the difference of the feeding amount of a sheet 30. A free running counter 55*a* is incremented in one direction by the reference pulses. A latch 55*c* is arranged to latch a counted value of the free running counter 55*a* synchronously with the output (rising edge or falling edge) signal of the mark sensor 43.

When O-holding command is issued by a CPU 56*a*, O-holding counter controller 55*b* makes the free running counter 55*a* hold 0. In synchronization with the next output (rising edge or falling edge) signal of the mark sensor 43, the free running counter 55*a* is made free from O-holding operation. Then, the CPU 56*a* calculates the difference in the feeding amount and also calculates the required compensation of the feeding amount. The CPU 56*a* also controls the O-holding counter controller 55*b* and further controls the motor driving pulse output STEPH and the printing periodicity. RAM 56*c* stores data which is used in calculation by CPU 56. ROM 56*d* stores a program. A compensation table 56*b* stores the compensation values associated with the feeding amount.

Now, basic compensation algorithm executed under the control of the CPU 56*a* will be described below. For simplicity, it is assumed that the compensation of the feeding amount error is carried out every one revolution of the follower roller 11 (as in the case of the third embodiment).

Each variable will be defined as follows:

| Revolution | 0 | 1 | 2 | 3 | 4 | ... |
|---|---|---|---|---|---|---|
| The cumulative number of the reference pulses associated with the printing of Y | 0 | $Y_1$ | $Y_2$ | $Y_3$ | $Y_4$ | ... |
| The cumulative number of the reference pulses associated with the printing of M (No Compensation) | 0 | $M_1$ | $M_2$ | $M_3$ | $M_4$ | ... |

-continued

| | | | | | | |
|---|---|---|---|---|---|---|
| The cumulative number of the reference pulses associated with the printing of M (Compensated) | 0 | $M_1'$ | $M_2'$ | $M_3'$ | $M_4'$ | ... |
| Revolution | 0 | 1 | 2 | 3 | 4 | ... |
| The number of the reference pulses per one revolution of the follower roller associated with the printing of Y | 0 | $y_1$ | $y_2$ | $y_3$ | $y_4$ | ... |
| The number of the reference pulses per one revolution of the follower roller associated with the printing of M (No Compensation) | 0 | $m_1$ | $m_2$ | $m_3$ | $m_4$ | ... |
| The number of the reference pulses per one revolution of the follower roller associated with the printing of M (Compensated) | 0 | $m_1'$ | $m_2'$ | $m_3'$ | $m_4'$ | ... |
| The error in the counted number per one revolution of the follower between M and Y ($m_3 - y_1$) | | $\Delta e_1$ | $\Delta e_2$ | $\Delta e_3$ | $\Delta e_4$ | ... |

Furthermore, the errors between successive each revolution of the follower roller will be defined for each color as follows:

$$E\,y_n = Y_{n+1} - y_n$$

$$E\,m_n = m_{n+1} - m_n$$

The compensation will be made for the second revolution on the color M as follows:

The relative change of the feeding amounts can be described by:

$$\begin{aligned} RAITE1 &= (M_1 - \Delta e_1)/M_1 \\ &= \{M_1 - (M_1 - Y_1)\}/M_1 \\ &= \{m_1 - (m_1 - y_1)\}/m_1 \end{aligned}$$

After the compensation is made, the number $m_2'$ of the pulses during the second revolution (the number of the pulses during one revolution of the follower roller) is given by:

$$\begin{aligned} m_2' &= m_2 \cdot RAITE1 \\ &= (m_1 + Em_1) \cdot (y_1/m_1) \\ &= y_1 + (y_1 \cdot m_1)/m_1 \end{aligned}$$

After the compensation is made, the cumulative error $\Delta E_1$ introduced during the second revolution is given by:

$$\begin{aligned} \Delta E_1 &= (m_1 + m_2') - Y_2 \\ &= (m_1 + m_2') - (y_1 + y_2) \\ &= \Delta e_2 - \Delta e_1 \cdot Em_1/m_1 \end{aligned}$$

In the above equation, after the compensation is made for the second revolution, the second terra on the right side of the equation becomes small enough. As a result, the error $\Delta e_1$ introduced during the first revolution is cancelled and only $\Delta e_1$ remains. Thus, after the compensation is made, the cumulative error $\Delta E_1$ introduced during the second revolution becomes:

$$\Delta E_1 = \Delta e_1 = \Delta e_1 + E\,m_1 - E\,y_1$$

For the third revolution, the compensation on the color M will be made as follows:

$$\begin{aligned} RAITE2 &= (m_1 - \Delta E_1)/m_1 \\ &= [m_1 - \{(m_1 + m_2') - (y_1 + y_2)\}]/m_1 \\ &= (m_1 - \Delta e_1 - Em_1 + Ey_1)/m_1 \end{aligned}$$

After the compensation is made, the number $m_2'$ of the pulses during the second revolution (the number of the pulses during one revolution of the follower roller) is given by:

$$\begin{aligned} m_3' &= m_3 \cdot RAITE2 \\ &= m_3 - m_3/m_1 \cdot (\Delta e_1 + Em_1 - Ey_1) \end{aligned}$$

After the compensation is made, the cumulative error $\Delta E_2$ introduced during the second revolution is given by:

$$\begin{aligned} \Delta E_2 &= (m_1 + m_2' + m_3') - (y_1 + y_2 + y_3) \\ &= (\Delta e_1 + Em_1 - Ey_1) + m_3' - y_3 \\ &= (\Delta e_1 + Em_1 - Ey_1) + m_3' - (y_1 + Ey_1 + Ey_2) \\ &\approx \Delta e_1 + (Em_1 + Em_2 - Ey_1 - Ey_2) \\ &= \Delta e_3 \end{aligned}$$

As can be seed from the above equations, after the compensation is made for the third revolution, $\Delta e_1$ and $\Delta e_2$ are cancelled and only $\Delta e_1$ remains.

Analyses are also carried out for the colors C and BK in the same way as that described above. The results will be summarized below. That is, the relative change of the feeding amount for nth revolution can be obtained as follows:

$$RAITEm(n) = (m_1 - \Delta Em_{n-1})/m_1;\ \text{for color } M$$

where $$\begin{aligned} \Delta Em_n &= M_n' - Y_n \\ &= m_1 + m_2' \ldots + m_n' - (y_1 + y_2 \ldots + y_n); \end{aligned}$$

$$RAITEc(n) = (c_1 - \Delta Ec_{n-1})/c_1;\ \text{for color } C$$

where $$\begin{aligned} \Delta Ec_n &= M_n' - Y_n \\ &= c_1 + c_2' \ldots + c_n' - (y_1 + y_2 \ldots + y_n); \end{aligned}$$

-continued $$RAITEb(n) = (b_1 - \Delta Eb_{n-1})/b_1; \text{ for color } BK$$

where $$\Delta Eb_n = M_n' - Y_n$$
$$= b_1 + b_2' \ldots + b_n' - (y_1 + y_2 \ldots + y_n).$$

Thus, if the periodicity of the driving pulse is controlled based on the relative changes calculated for each of revolutions, it becomes possible to reduce the registration error between colors. If it is assumed that the repetition period of the driving pulses with no compensation is described by PS, then its compensated repetition period becomes:

$$PS \times RAITE$$

When it is difficult to consecutively perform real time calculation to obtain RAITE and the compensated repetition period of the driving pulses because of the limitation of the processing time or some reasons, this problem may be solved by preparing a table which provides the results of the calculation on RAITE and the changes in repetition periods.

A method for realizing the algorithm mentioned above with the configuration shown in FIG. 9 will be described below.

In this example, it will be assumed that the disk 42 has twelve marks.

Figure 10:
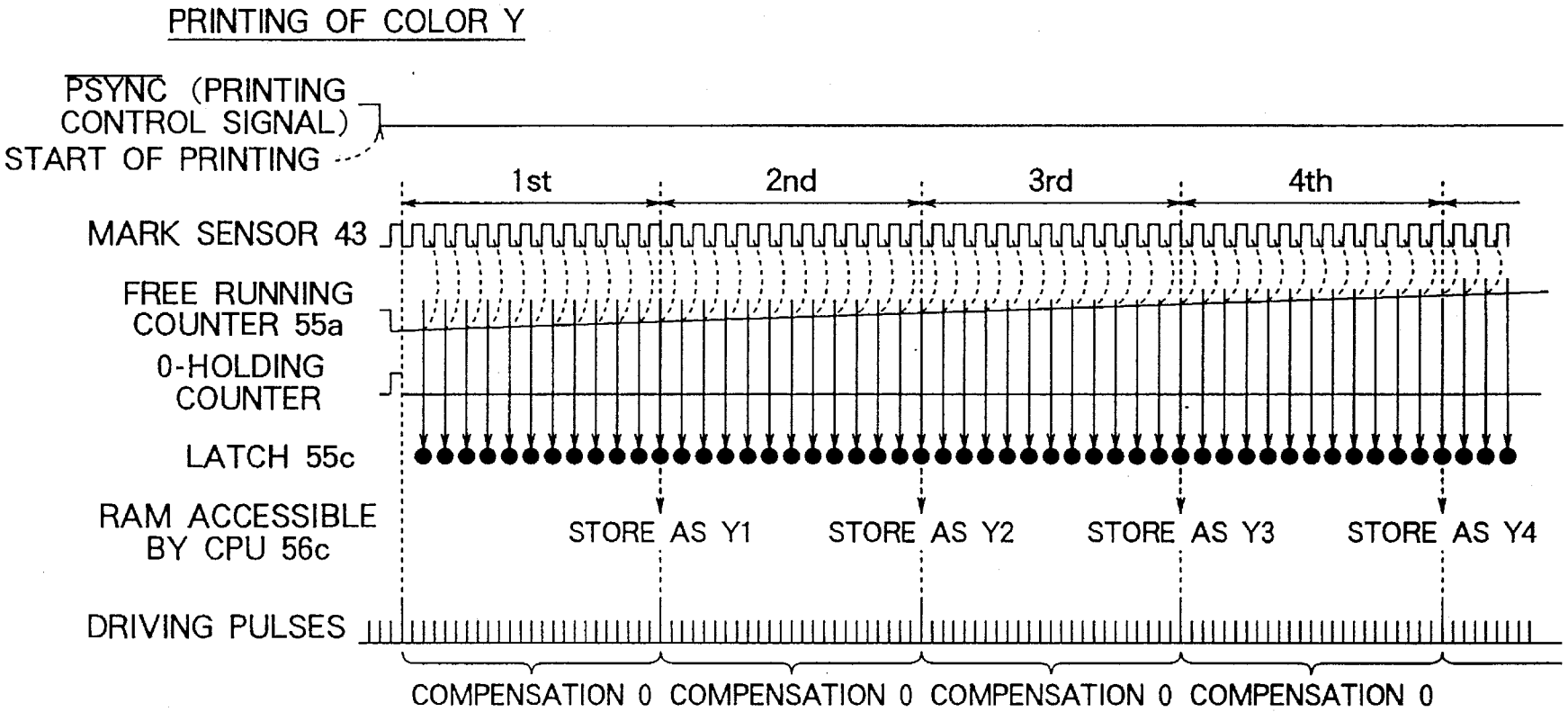
FIG. 10 is a liming chart of the printing process associated with color Y in accordance with the sixth embodiment of the present invention.
Figure 11:
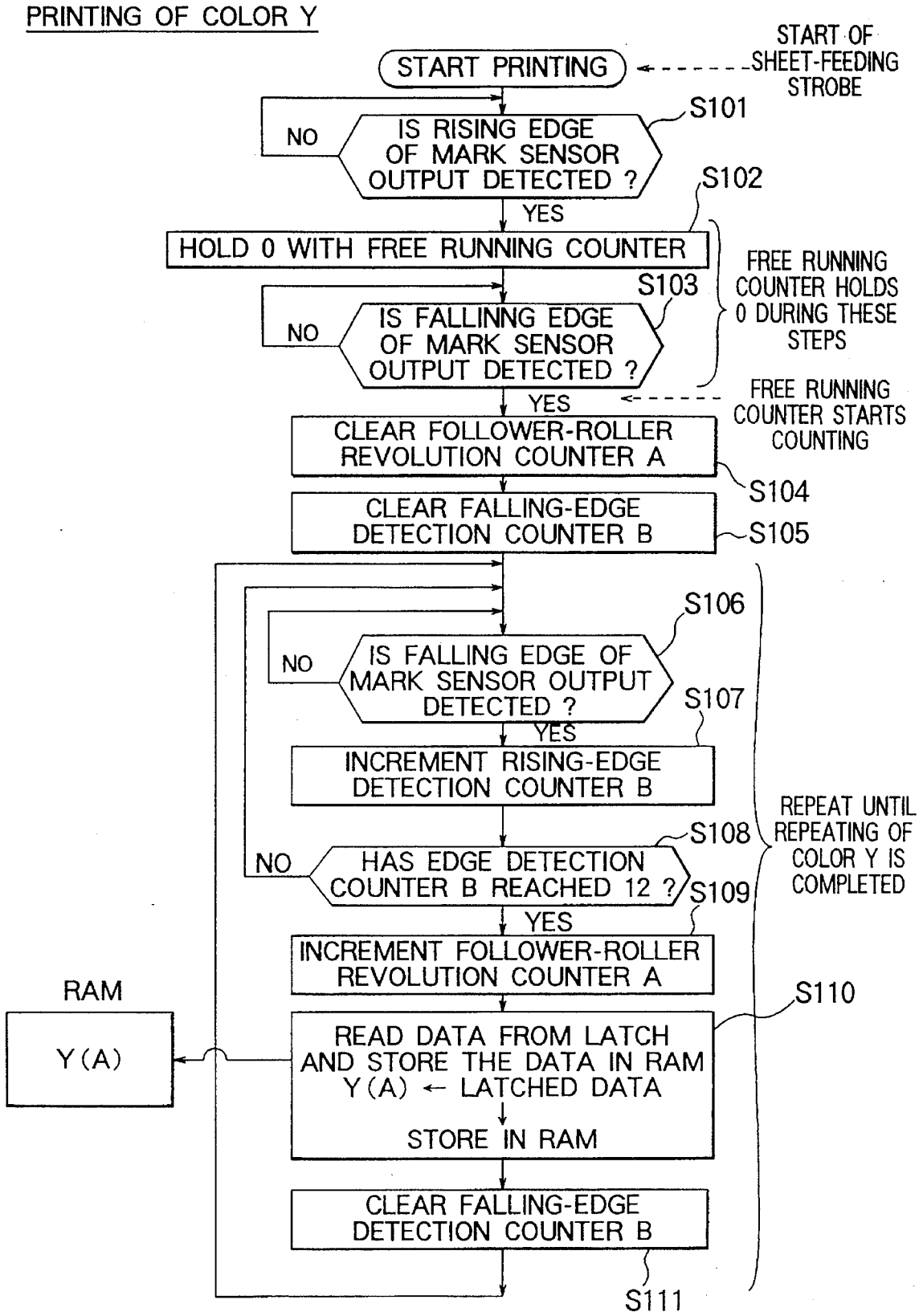
FIG. 11 is a flow chart of the printing process associated with color Y in accordance with the sixth embodiment of the present invention.
Figure 12:
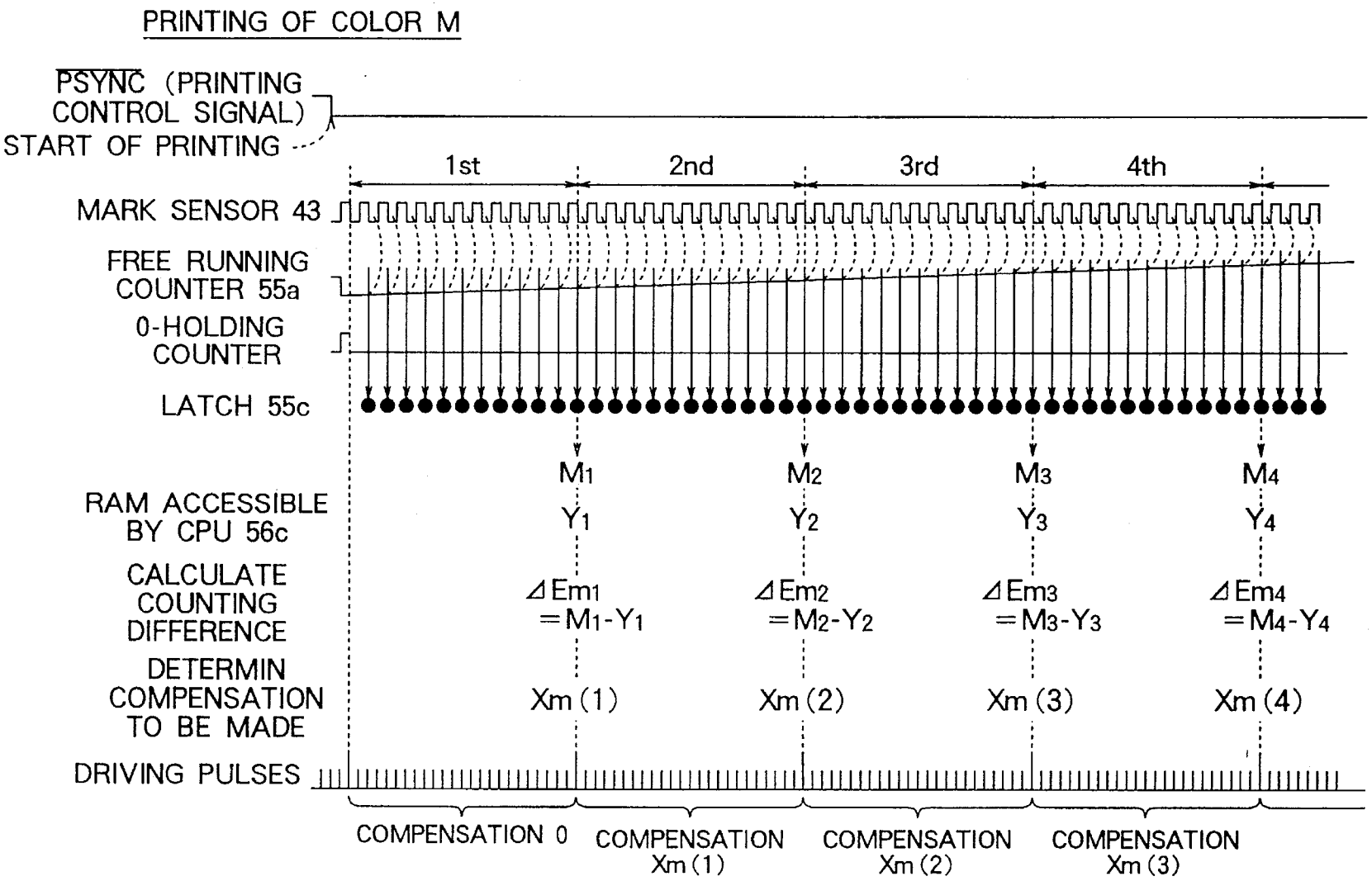
FIG. 12 is a timing chart of the printing process associated with color M and the other processes following that in accordance with the sixth embodiment of the present invention.
Figure 13:
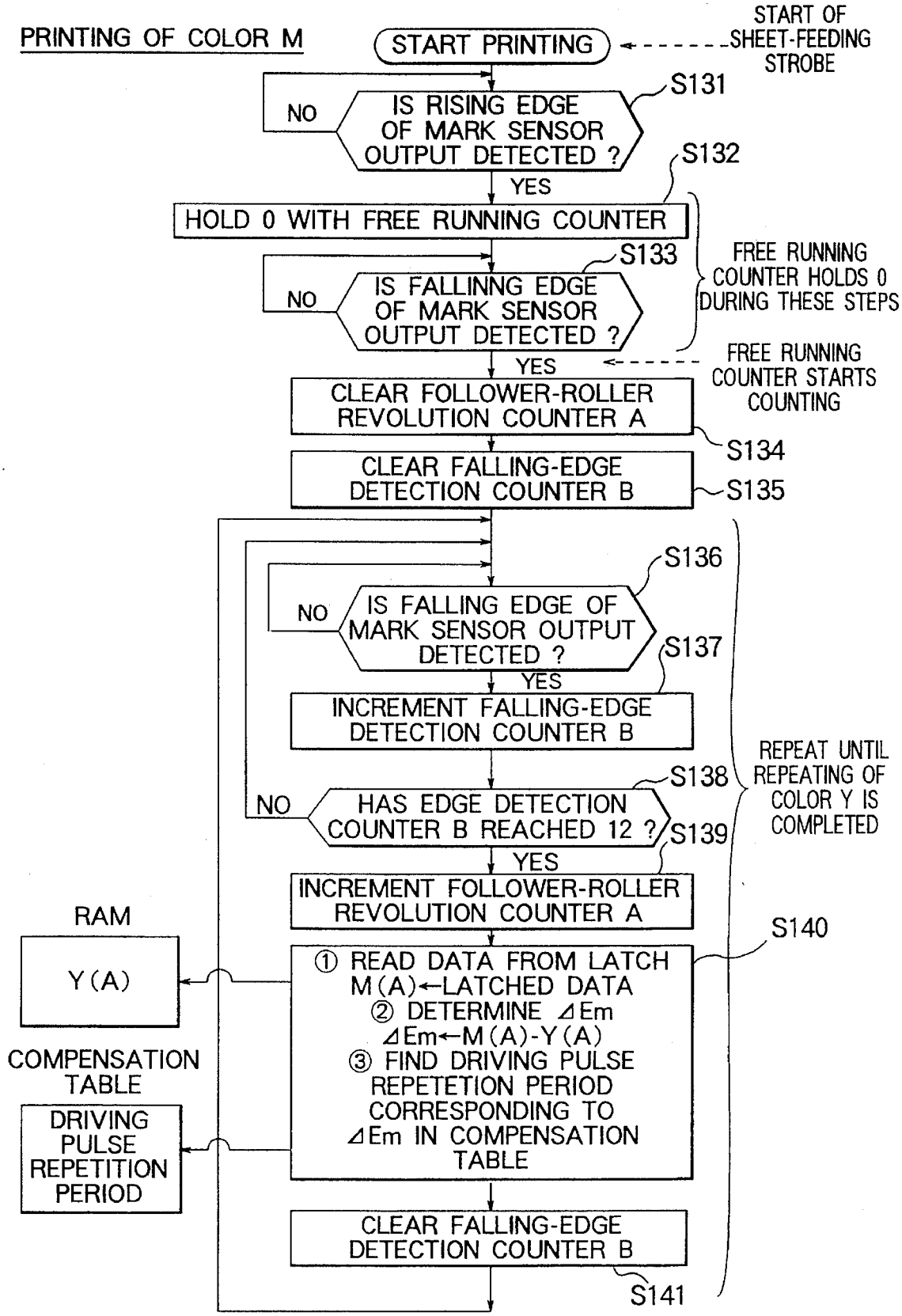
FIG. 13 is a flow chart of the printing process associated with color M and the other processes following that in accordance with the sixth embodiment of the present invention.

With reference to the signal timing chart in FIG. 10 and the process flow chart in FIG. 11, printing of color Y will be described hereinbelow:

(1) Printing starts. That is to say, the driving motor 11 is made to operate to feed a sheet and the thermal head 9 performs printing. At this stage, the repetition period of the driving pulses is kept constant without performing compensation of the feeding amount of the sheet.

(2) CPU 568 monitors the outputs of the mark sensor 43. When the CPU 56*a* detects a rising edge of the output, the CF. 56*a* makes the O-holding counter controller 55*b* control the counter 55*a* so that the counter 55*a* holds 0 (step S1O1, S102).

(3) Printing is continued. When the CPU 56*a* detects a falling edge of the output of the mark sensor 43, the CPU 56*a* clears the built-in counter A used for counting the number of the revolutions of the follower roller. At this stage, when an falling edge of the output of the mark sensor 43 is detected, the O-holding counter controller 55*b* makes the free running counter 55*a* free from the O-holding operation (steps S103 and S104).

(4) Then, the built-in edge detecting counter B used for counting the falling edges of the outputs of the mark sensor 43 is cleared (step S105).

(5) The edge detecting counter B is incremented each time a falling edge of the output of the marks sensor 43 is detected (steps S106 and S107).

(6) When the counter B counts twelve, the CPU 56*a* increments the revolution counter A and the CPU 56*a* reads data from the latch 55*c* and stores the data in the accessible RAM 56*c*. In this process, the storing of the counting value in the latch 55*c* from the free running counter 55*a* is performed when a falling edge of the output of the mark sensor 43 is detected, (steps S108–S110)

(7) The edge detecting counter B is cleared (step S111).

(8) The sequence (5)–(7) is repeated until printing is completed.

With reference to FIG. 9, printing process of color M is described below:

(1) Printing starts. That is to say, the driving motor 11 is made to operate to feed the sheet and the thermal head 9 performs printing. At this stage, the repetition period of the driving pulses is kept constant, without performing compensation of the feeding amount of the sheet.

(2) CPU 56*a* monitors the outputs of the mark sensor 43. When the CPU 56*a* detects a rising edge of the output, the CPU 56*a* makes the O-holding counter controller 55*b* control the counter 55*a* so that the counter 55*a* holds 0 (step S131, S132).

(3) Printing is continued. When the CPU 56*a* detects a falling edge of the output of the mark sensor 43, the CPU 56*a* clears the built-in counter A used for counting the number of the revolutions of the follower roller. At this stage, when an falling edge of the output of the mark sensor 43 is detected, the O-holding counter controller 55*b* makes the free running counter 55*a* free from the O-holding operation (steps S133 and S134).

(4) Then, the built-in edge detecting counter B used for counting the falling edges of the outputs of the mark sensor 43 is cleared (step S135).

(5) The edge detecting counter B is incremented each time a falling edge of the output of the marks sensor 43 is detected (steps S136 and S137).

(6) When the counter B counts twelve, the CPU 56*a* increments the revolution counter A and the CPU 56*a* reads data from the latch 55*c*. Using the stored counting value and also the counting value read from the latch at this time, the CPU 56*a* determines RAITE and the compensated repetition period of the driving pulses. According to these results, the CPU 56*a* controls the feeding amount of the sheet. (steps S138–S140)

(7) The edge detecting counter B is cleared (step S141).

(8) The sequence (5)–(7) is repeated until printing is completed,

In the above description, the calculation is performed in real time to determine the repetition period of the driving pulses. However, if the enough calculation time is not available because of the limitation of the processing capability of the CPU 56*a* or other reasons, the solution to this problem may be to prepare a table which provides the compensated repetition periods of the driving pulses calculated for each parameter such as $m_1$ (or $c_1$, $b_1$) and $\Delta E\ m_2$ (or $\Delta E\ c_2$, $\Delta E\ b_2$).

When $m_1$ (or $c_1$, $b_1$) is extremely small compared to $\Delta E\ m_2$ (or $\Delta E\ c_2$, $\Delta E\ b_2$), it becomes possible to prepare the table in which one value of the repetition period of the driving pulses corresponds to each value of $\Delta E\ m_2$ (or $\Delta E\ c_2$, $\Delta E\ b_2$). In this case, it is possible to achieve the great reduction in the amount of data to be stored in the table. The compensation error introduced by approximating the compensated value by one value will be detected as a counting difference in the following revolution and this error will be compensated a5 that time. FIG. 19 shows an example of such a table.

Now, a seventh embodiment will be described hereinbelow. In contrast to the sixth embodiment described above, the target to be compensated is the repetition period of printing in this seventh embodiment. This is useful for the case where the driving pulses cannot be finely adjusted because the hardware generates pulses automatically and only the repetition period of printing is fine-adjustable. In this ninth embodiment, the periodicity between lines (a printing strobe, for example) is modified based on the relative change RAITE as obtained in the fourth embodiment. If the base repetition period of printing (the repetition period with no compensation) is described by SC, the compensated strobe period is given by:

$$SC \times RAITE$$

Figure 14:
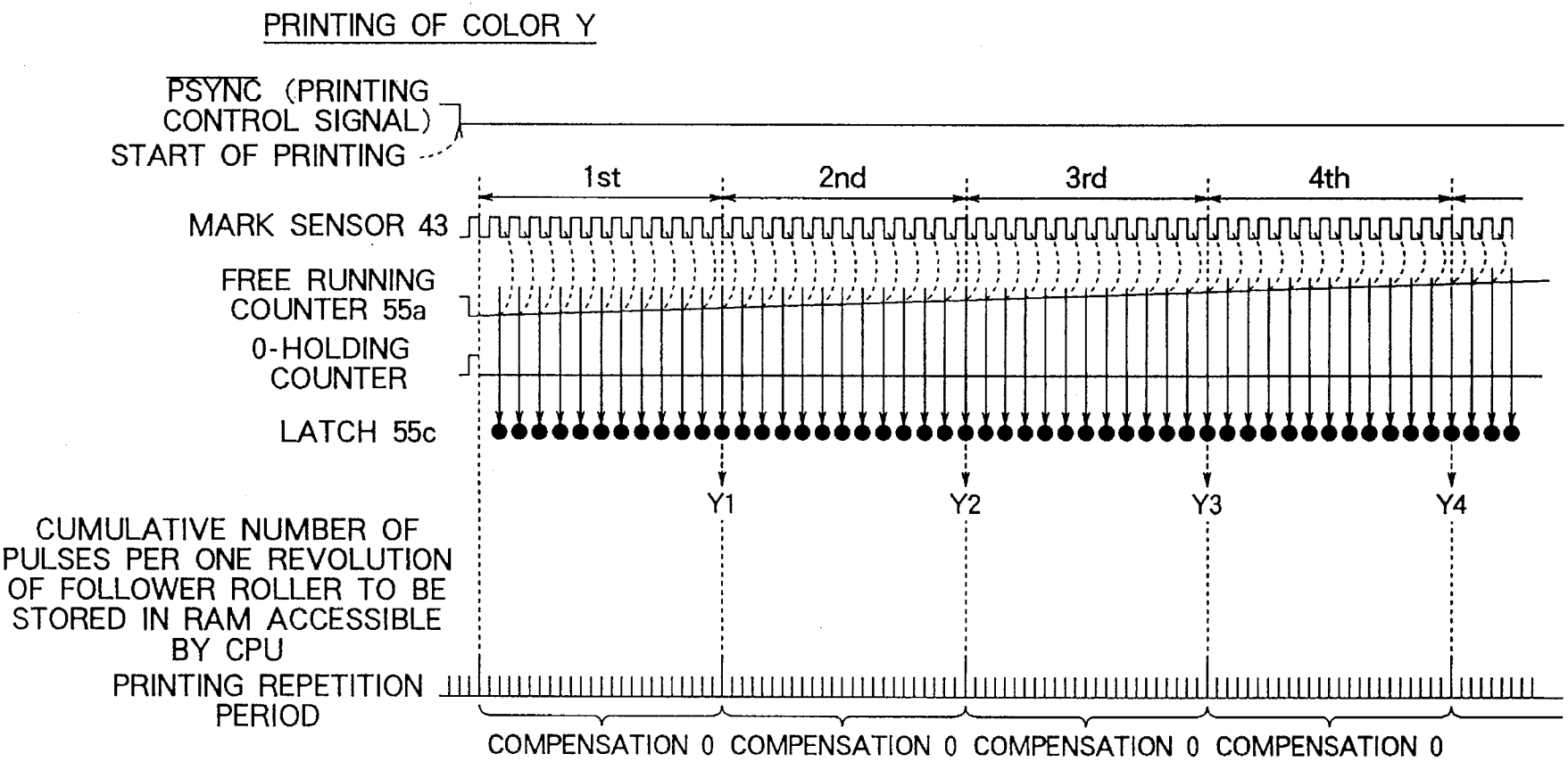
FIG. 14 is a timing chart of the printing process associated with color Y in accordance with a seventh embodiment of the present invention.
Figure 15:
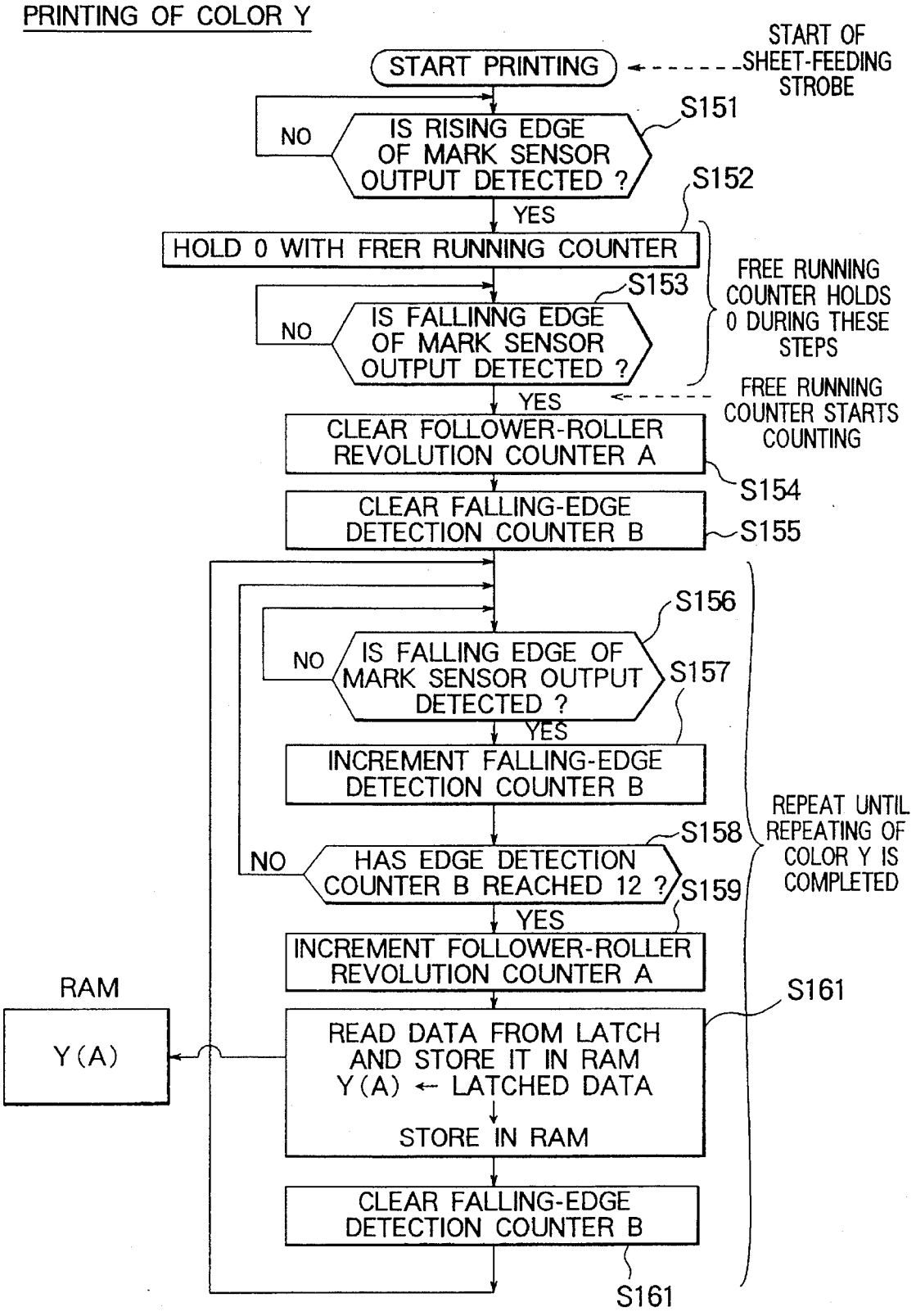
FIG. 15 is a flow chart of the printing process associated with color Y in accordance with the seventh embodiment of the present invention.

With reference to the signal timing chart in FIG. 14 and the process flow chart in FIG. 15, printing of color Y will be described hereinbelow:

(1) Printing start's. That is to say, the driving motor 11 Is made to operate to feed a sheet and the thermal head 9 performs printing. At this stage, the repetition period of the driving pulses is kept constant without performing compensation of the feeding amount of the sheet.

(2) CPU 56*a* monitors the outputs of the mark sensor 43. When the CPU 56*a* detects a rising edge of the output, the CPU 56*a* makes the O-holding counter controller 55*b* control the counter 55*a* so that the counter 55*a* holds 0 (step S151, S152).

(3) Printing is continued. When the CPU 56*a* detects a falling edge of the output of the mark sensor 43, the CPU 58*a* clears the built-in counter A used for counting the number of the revolutions of the follower roller. At this stage, when an falling edge of the output of the mark sensor 43 is detected, the O-hoiding counter controller 55*b* makes the free running counter 55*a* free from the O-holding operation (steps S153 and S154).

(4) Then, the built-in edge detecting counter B used for counting the falling edges of the outputs of the mark sensor 43 is cleared (step S155).

(5) The edge detecting counter B is incremented each time a falling edge of the output of the marks sensor 43 is detected (steps S156 and S157).

(6) When the counter B counts twelve, the CPU 56*a* increments the revolution counter A and the CPU 56*a* reads data from the latch 55*c* and stores the data in the accessible RAM 56*c* In this process, the storing of the counting value in the latch 55*c* from the free running counter 55*a* is performed when a falling edge of the output of the mark sensor 43 is detected. (steps S158–S160)

(7) The edge detecting counter B is cleared (step S161).

(8) The sequence (5)–(7) is repeated until printing is completed.

Figure 16:
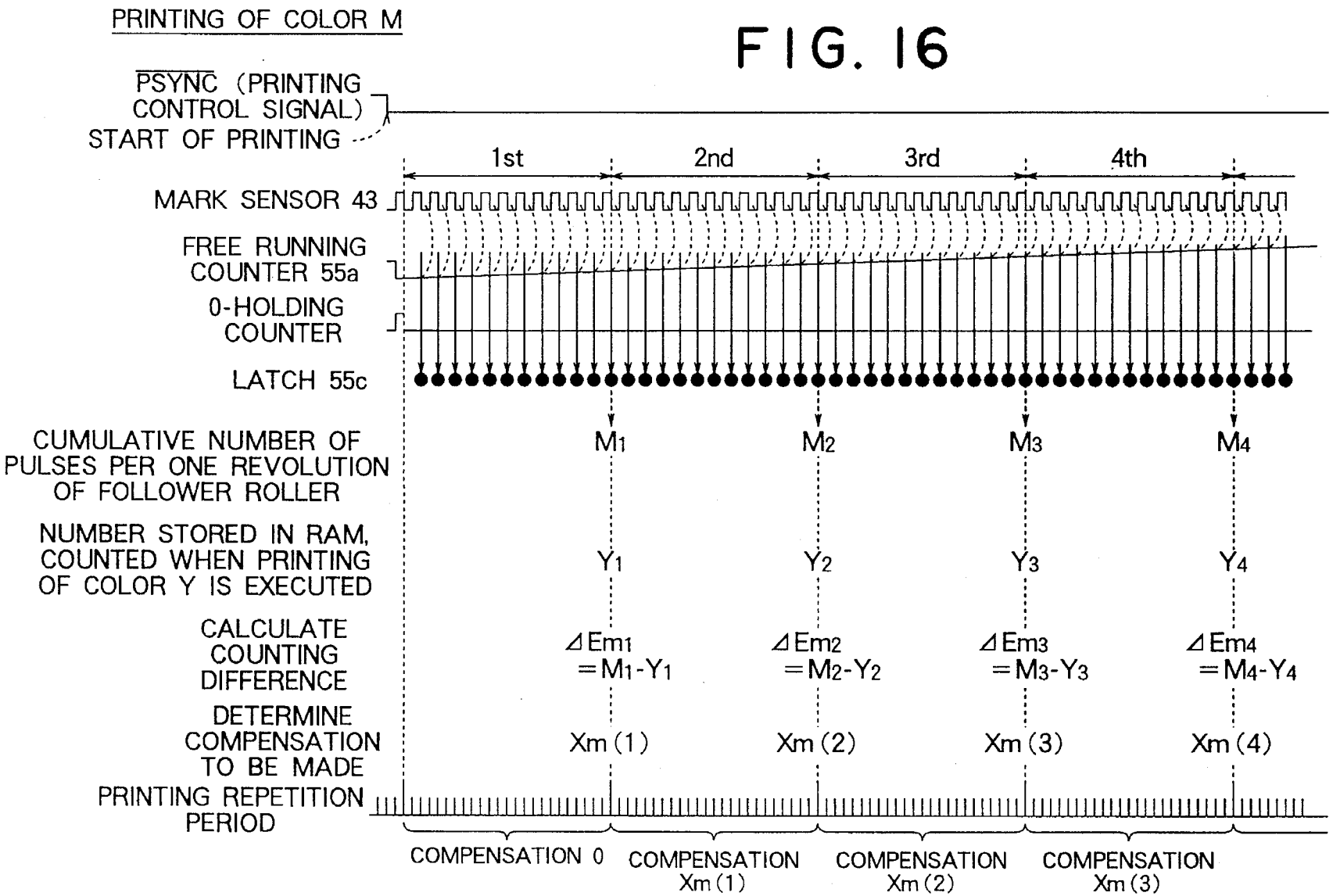
FIG. 16 is a timing chart of the printing process associated with color M and the other processes following that in accordance with the seventh embodiment of the present invention.
Figure 17:
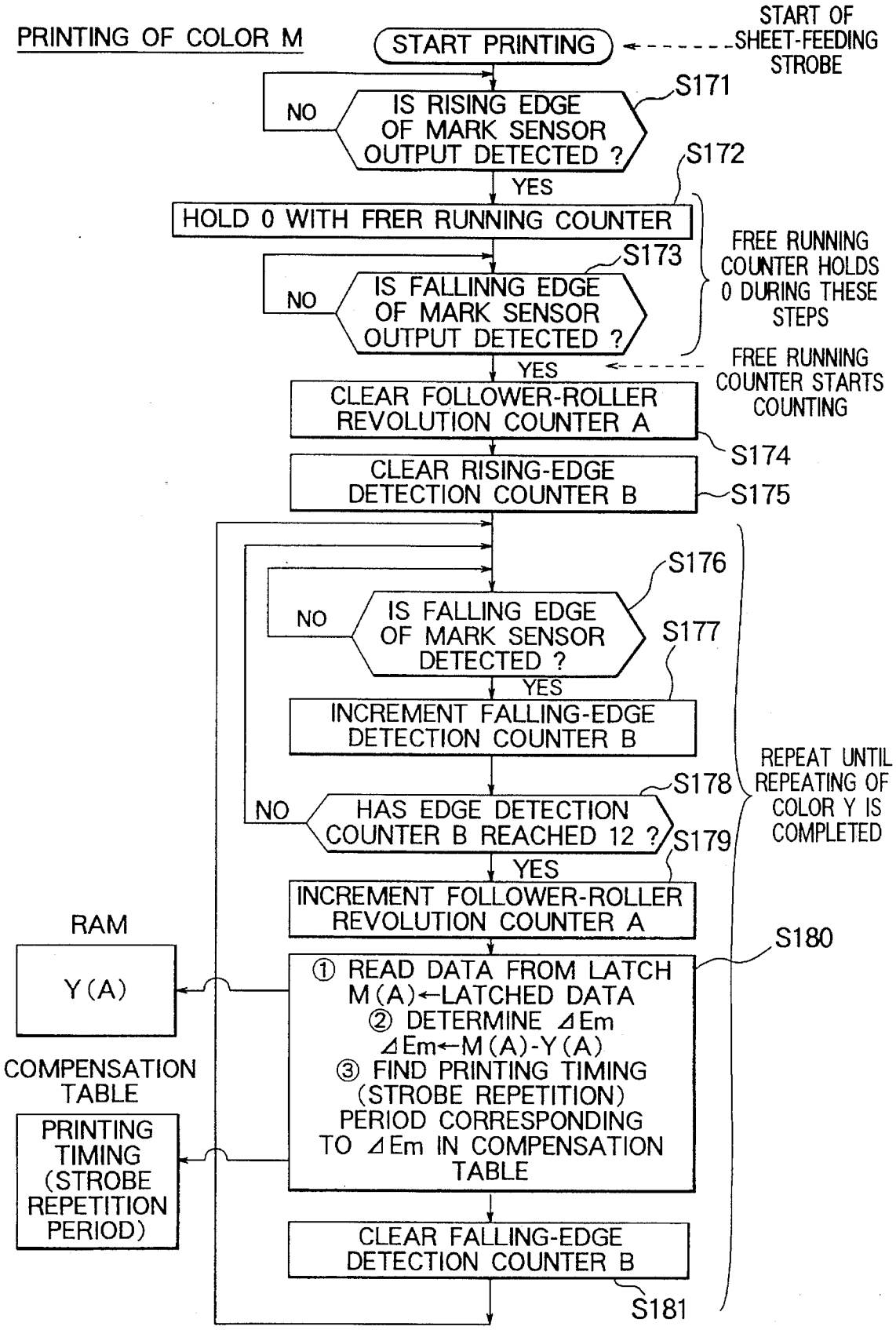
FIG. 17 is a flow chart of the printing process associated with color M and the other processes following that in accordance with the seventh embodiment of the present invention.

With reference to the signal timing chart in FIG. 16 and the process flow chart in FIG. 17, printing of color M will be described hereinbelow:

(1) Printing starts. That is to say, the driving motor 11 is made to operate to feed the sheet and the thermal head 9 performs printing. At this stage, the repetition period of the driving pulses is kept constant without performing compensation of the feeding amount of the sheet.

(2) CPU 56*a* monitors the outputs of the mark sensor 43. When the CPU 56*a* detects a rising edge of the output, the CPU 56*a* makes the O-holding counter controller 55*b* control the counter 55*a* so that the counter 55*a* holds 0 (step S171, S172).

(3) Printing is continued. When the CPU 56*a* detects a falling edge of the output of the mark sensor 43, the CPU 56*a* clears the built-in counter A used for counting the number of the revolutions of the follower roller. At this stage, when an falling edge of the output of the mark sensor 43 is detected, the O-holding counter controller 55*b* makes the free running counter 55*a* free from the O-holding operation (steps S173 and S174).

(4) Then, the built-in edge detecting counter B used for counting the falling edges of the outputs of the mark sensor 43 is cleared (step S175).

(5) The edge detecting counter B is incremented each time a falling edge of the output of the marks sensor 43 detected (steps S176 and 8177).

(6) When the counter g counts twelve, the CPU 56*a* increments the revolution counter A and the CPU 56*a* reads data from the latch 55*c*. Using the stored counting value and also the counting value read from the latch this time, the CPU 56*a* determines RAITE and the compensated repetition period of printing. According to these results, the CPU 56*a* controls the feeding amount of the sheet. (steps S178–S180)

(7) The edge detecting counter B is cleared (step S181).

(8) The sequence (5)–(7) is repeated until printing is completed.

In the above description, the calculation is performed in real time to determine the repetition period of printing. However, if the enough calculation time is not available because of the limitation of the processing capability of the CPU 56*a* or other reasons, the solution to this problem may be to prepare a table which provides the compensated repetition periods of printing calculated for each parameter such as $m_1$ (or $c_1$, $b_1$) and $\Delta E\ m_2$ (or $\Delta E\ c_2$, $\Delta E\ b_2$).

When $m_1$ (or $c_1$, $b_1$) is extremely small compared to $\Delta E\ m_2$ (or $\Delta E\ c_2$, $\Delta E\ b_2$), it becomes possible to prepare the table in which one value of the repetition period of printing corresponds to each value of $\Delta E\ m_2$ (or $\Delta E\ c_2$, $\Delta E\ b_2$). In this case, it is possible to achieve the great reduction in the amount of data to be stored in the table. The compensation error introduced by approximating the compensated value by one value will be detected as a counting difference in the following revolution and this error will be compensated at that time. FIG. 19 shows an example of such a table.

Now, an eighth embodiment will be described hereinbelow. This embodiment is obtained by modifying the fifth embodiment such that the printing length for each of colors Y, M, C, and BK is adjusted to the reference printing length.

The basic compensation algorithm will be described below. F of simplicity, it is assumed that the compensation of the feeding amount error is carried out every one revolution the follower roller 11 (as in the case of the third embodiment),

| Revolution | 0 | 1 | 2 | 3 | 4 | ... |
|---|---|---|---|---|---|---|
| The cumulative number of the reference pulses associated with the reference printing length | 0 | $R_1$ | $R_2$ | $R_3$ | $R_4$ | ... |
| The cumulative number of the reference pulses associated with the printing of M (No Compensation) | 0 | $Y_1$ | $Y_2$ | $Y_3$ | $Y_4$ | ... |
| The cumulative number of the reference pulses associated with the printing of M (Compensated) | 0 | $Y_1'$ | $Y_2'$ | $Y_3'$ | $Y_4'$ | ... |
| Revolution | 0 | 1 | 2 | 3 | 4 | ... |

-continued

| | | | | | | |
|---|---|---|---|---|---|---|
| The number of the reference pulses per one revolution of the follower roller associated with the reference printing length | 0 | $r_1$ | $r_2$ | $r_3$ | $r_4$ | . . . |
| The number of the reference pulses per one revolution of the follower roller associated with the printing of Y (No Compensation) | 0 | $y_1$ | $y_2$ | $y_3$ | $y_4$ | . . . |
| The number of the reference pulses per one revolution of the follower roller associated with the printing of Y (Compensated) | 0 | $y_1'$ | $y_2'$ | $y_3'$ | $y_4'$ | . . . |
| The error in the counted number per one revolution of the follower roller between Y and R ($y_1 - r_2$) | | $\Delta e_1$ | $\Delta e_2$ | $\Delta e_3$ | $\Delta e_4$ | . . . |

Furthermore, the errors between successive each revolution of the follower roller wall be defined for each color as follows:

$$E\,y_2 = y_{2+1} - y_2$$

The compensation will be made for the second revolution on the color Y as follows:

The relative change of the feeding amounts can be described by:

$$\begin{aligned} RAITE1 &= (Y_1 - \Delta e_1)/Y_1 \\ &= \{Y_1 - (Y_1 - R_1)\}/Y_1 \\ &= \{y_1 - (y_1 - r_1)\}/y_1 \end{aligned}$$

After the compensation is made, the number $Y_2'$ or the pulses during the second revolution (the number of the pulses during one revolution of the follower roller) is given by:

$$\begin{aligned} y_2' &= y_2 \cdot RAITE1 \\ &= (y_1 + Ey_1) \cdot (r_1/y_1) \\ &= r_1 + (r_1 \cdot y_1)/y_1 \end{aligned}$$

After the compensation is made, the cumulative error introduced during the second revolution is given by:

$$\begin{aligned} \Delta E_1 &= (y_1 + y_2') - R_2 \\ &= (y_1 + y_2') - (r_1 + r_2) \\ &= \Delta e_2 - \Delta e_1 \cdot y_1/y_1 \end{aligned}$$

In the above equation, after the compensation is made for the second revolution, the second term on the right side of the equation becomes small enough. As a result, the error $\Delta e_1$ introduced during the first revolution is cancelled and only $\Delta e_2$ remains. Thus, after the compensation is made, the cumulative error $\Delta E_1$ introduced during the second revolution becomes $\Delta e_2$.

For the third revolution, the compensation on the color Y will be made as follows:

$$\begin{aligned} RAITE2 &= (y_1 - \Delta E_1)/r_1 \\ &= [y_1 - \{(y_1 + y_2') - (r_1 + r_2)\}]/y_1 \\ &= (y_1 - \Delta e_1 - Ey_1 + Er_1)/y_1 \end{aligned}$$

After the compensation is made, the number $y_2'$ of the pulses during the second revolution (the number of the pulses during one revolution of the follower roller) is given by:

$$\begin{aligned} y_3' &= y_3 \cdot RAITE2 \\ &= y_3 - y_3/y_1 \cdot (\Delta e_1 + Ey_1 - Er_1) \end{aligned}$$

After the compensation is made, the cumulative error $\Delta E_2$ introduced during the second revolution is given by:

$$\begin{aligned} \Delta E_2 &= (y_1 + y_2' + y_3') - (r_1 + r_2 + r_3) \\ &= (\Delta e_1 + Ey_1 - Er_1) + y_3' - r_3 \\ &= (\Delta e_1 + Ey_1 - Er_1) + y_3' - (r_1 + Er_1 + Er_2) \\ &\approx \Delta e_1 + (Ey_1 + Ey_2 - Er_1 - Er_2) \\ &= \Delta e_3 \end{aligned}$$

As can be seen from the above equations, after the compensation is made for the third revolution, $\Delta e_1$ and $\Delta e_2$ are cancelled and only $\Delta e_3$ remains. Therefore, the cumulative error $\Delta E_2$ introduced during the third revolution becomes $\Delta e_3$.

Analyses are also carried out for the colors C and BK in the same way as that described above. The results will be summarized below. That is, the relative change of the feeding amount for nth revolution can be obtained as follows:

$RAITEy(n) = (y_1 - \Delta Ey_{n-1})/y_1$; for color $Y$ where $$\begin{aligned} \Delta Ey_n &= Y_n' - R_n \\ &= y_1 + y_2' \ldots + y_n' - (r_1 + r_2 \ldots + r_n); \end{aligned}$$

$RAITEm(n) = (m_1 - \Delta Em_{n-1})/m_1$; for color $M$ where $$\begin{aligned} \Delta Em_n &= M_n' - R_n \\ &= m_1 + m_2' \ldots + m_n' - (r_1 + r_2 \ldots + r_n); \end{aligned}$$

$RAITEc(n) = (c_1 - \Delta Ec_{n-1})/c_1$; for color $C$ where $$\begin{aligned} \Delta Ec_n &= M_n' - R_n \\ &= c_1 + c_2' \ldots + c_n' - (y_1 + y_2 \ldots + y_n); \end{aligned}$$

$RAITEb(n) = (b_1 - \Delta Eb_{n-1})/b_1$; for color $BK$ where $$\begin{aligned} \Delta Eb_n &= M_n' - R_n \\ &= b_1 + b_2' + \ldots + b_n' - (r_1 + r_2 \ldots + r_n). \end{aligned}$$

Thus, if the periodicity of the driving pulse is controlled based on the relative changes calculated for each of revolutions, it becomes possible to reduce the registration error between colors. If it is assumed that the repetition period of the driving pulses with no compensation is described by PS, then its compensated repetition period becomes:

*PS×RAITE*

When it is difficult to consecutively perform real time calculation to obtain RAITE and the compensated repetition period of the driving pulses because of the limitation of the processing time or some reasons, this problem may be solved by preparing a table which provides the results of the calculation on RAITE and the changes in repetition periods.

Figure 20:
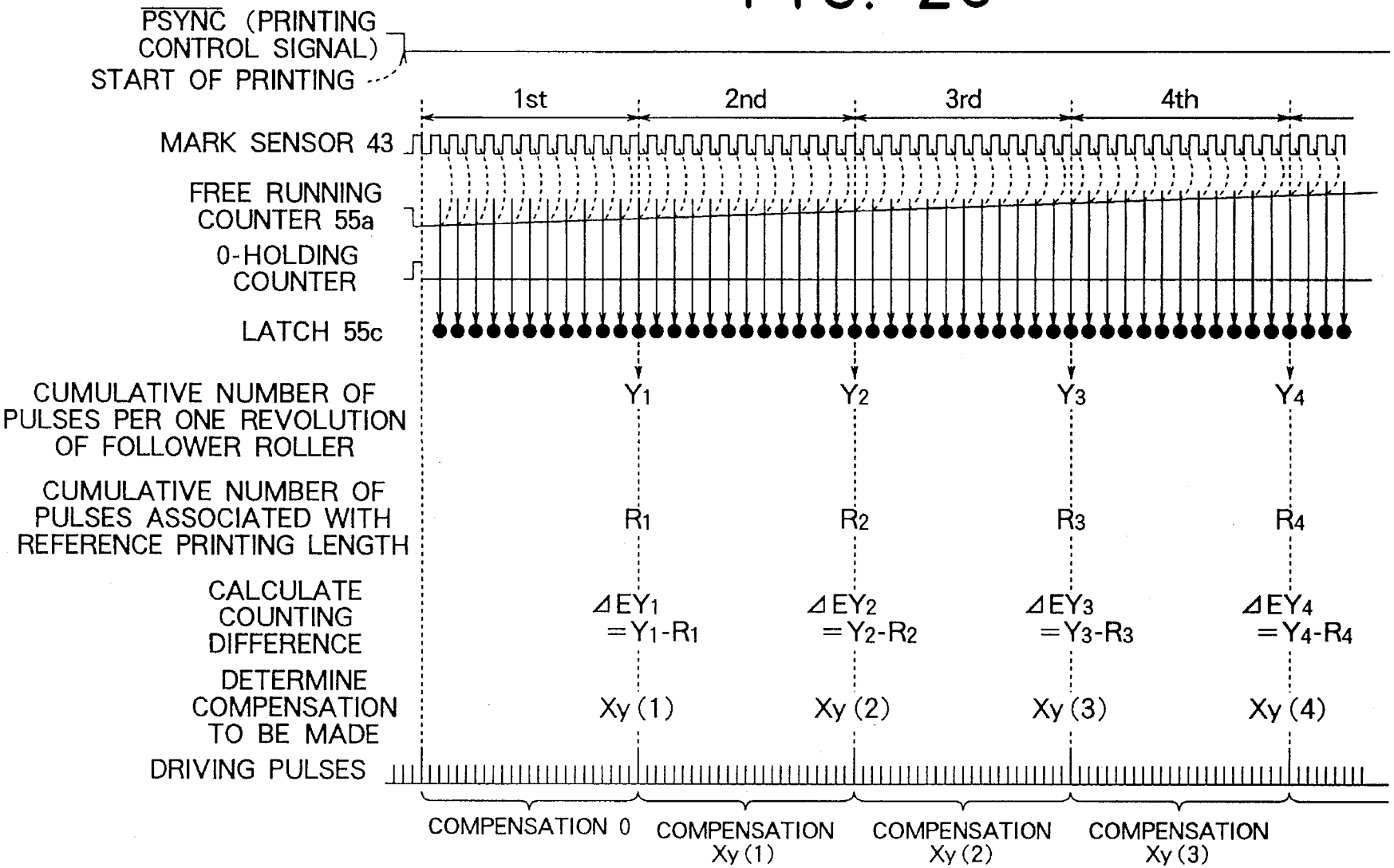
FIG. 20 is a timing chart of the process in accordance with the eighth embodiment of the present invention.
Figure 21:
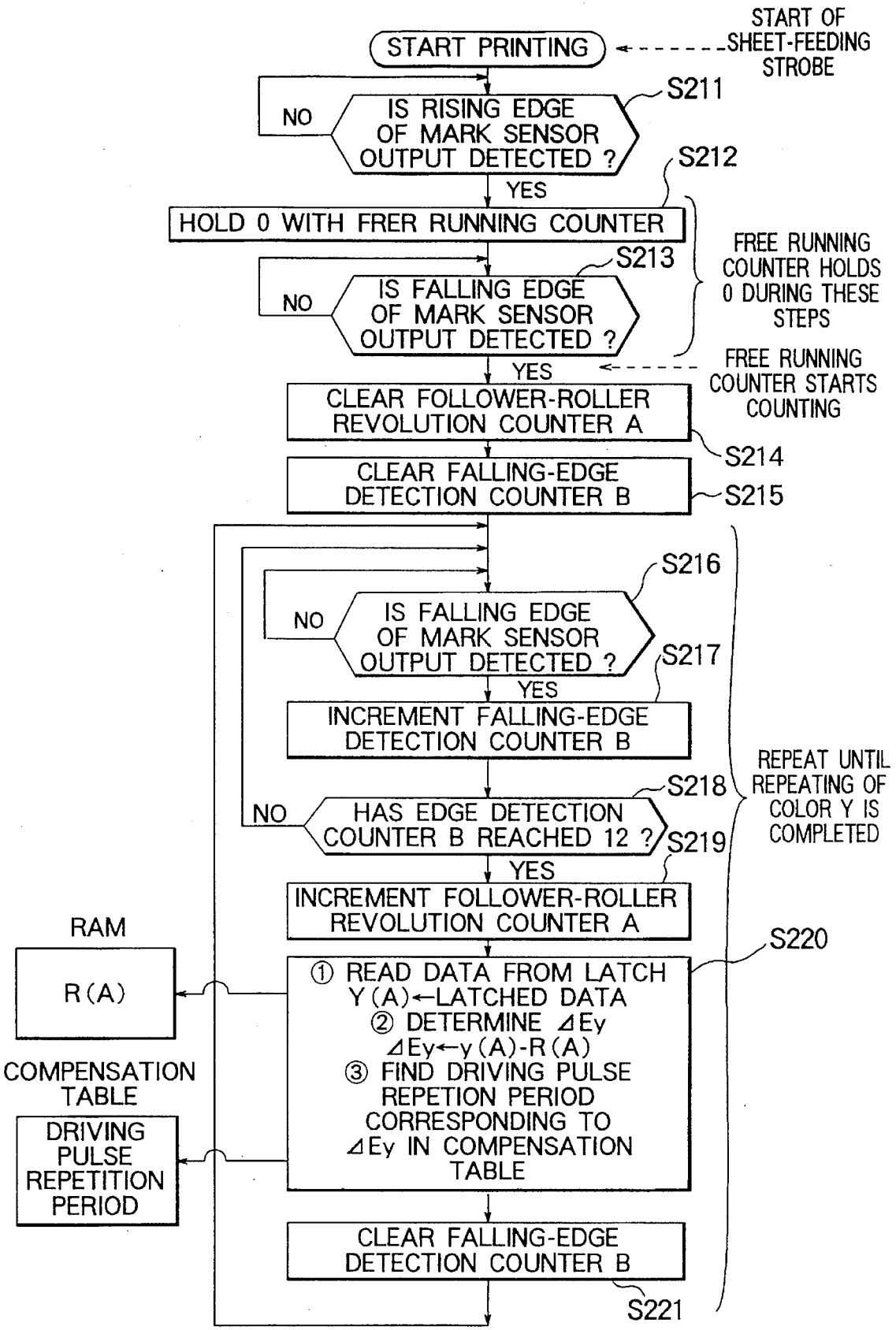
FIG. 21 is a flow chart of the process in accordance with the eighth embodiment of the present invention.

A method for realizing the algorithm mentioned above with the configuration shown in FIG. 9 will be described below with reference to the signal timing chart in FIG. 20 and the process flow chart in FIG. 21. In this example, it will be assumed that the disk 42 has twelve marks.

(1) Printing starts. That is to say, the driving motor 11 is made to operate to feed a sheet and the thermal head 9 performs printing. At this stage, the repetition period of the driving pulses is kept constant without performing compensation of the repetition period of printing (strobe period).

(2) CPU 56*a* monitors the outputs of the mark sensor 43. When the CPU 56*a* detects a rising edge of the output, the CPU 56*a* makes the O-holding counter controller 55*b* control the counter 55*a* so that the counter 55*a* holds 0 (step S211, S212).

(3) Printing is continued. When the CPU 56*a* detects a falling edge of the output of the mark sensor 43, the CPU 56*a* clears the built-in counter A used for counting the number of the revolutions of the follower roller. At this stage, when an falling edge of the output of the mark sensor 43 is detected, the O-holding counter controller 55*b* makes the free running counter 55*a* free from the O-holding operation (steps S213 and S214).

(4) Then, the built-in edge detecting counter B used for counting the falling edges of the outputs of the mark sensor 43 is cleared (step S215).

(5) The edge detecting counter B is incremented each time a falling edge of the output of the marks sensor 43 is detected (steps S216 and S217).

(6) When the counter B counts twelve, the CPU 56*a* increments the revolution counter A and the CPU 56*a* reads data from the latch 55*c*. Using the reference counting value and also the counting value just read from the latch at this time, the CPU 56*a* determines RAITE and the compensated repetition period of the driving pulses. According to these results, the CPU 56*a* controls the feeding amount of the sheet. (steps S218–S220)

(7) The edge detecting counter B is cleared (step S221).

(8) The sequence (5)–(7) is repeated until printing is completed.

In the above description, the calculation is performed in real time to determine the repetition period of the driving pulses. However, if the enough calculation time is not available because of the limitation of the processing capability of the CPU 56*a* or other reasons, the possible solution to this problem is to prepare a table which provides the compensated repetition periods of the driving pulses calculated for each parameter such as $m_1$ (or $c_1$, $b_1$) and $\Delta E\ m_2$ (or $\Delta E\ c_2$, $\Delta E\ b_2$).

When $m_1$ (or $c_1$, $b_1$) is extremely small compared to $\Delta E\ m_2$ (or $\Delta E\ c_2$, $\Delta E\ b_2$), it becomes possible to prepare the table in which one value of the repetition period of the driving pulses corresponds to each value of $\Delta E\ m_2$ (or $\Delta E\ c_2$, $\Delta E\ b_2$). In this case, it is possible to achieve the great reduction in the amount of data to be stored in the table. The compensation error introduced by approximating the compensated value by one value will be detected as a counting difference in the following revolution and this error will be compensated at that time. FIG. 19 shows an example of such a table.

In the arrangement shown in FIG. 9, there may exist variations in the size of the sheet-feeding driving roller 1 from one to another. Therefore, even if the sheet-feeding driving roller 1 is driven at the same speed to perform printing, the variations may occur in the printing length from one apparatus to another. If printing is performed for a standard length and if the counting values for this printing are measured and stored for each unit angle of revolution of the follower roller 41, then it becomes possible to make compensation based on these stored counting values to reduce the difference in the printing length from one apparatus to another. Furthermore, if it makes possible to modify the reference counting number by arbitrary method and at arbitrary time, it becomes possible to reduce the change in the printing length occurring due to the aging effects.

Now, a ninth embodiment will be described hereinbelow. In contrast to the seventh embodiment described above, the target to be compensated is the repetition period or printing in this ninth embodiment. This is useful for the case where the driving pulses cannot be finely adjusted because the hardware generates pulses automatically and only the repetition period of printing is fine-adjustable. In this ninth embodiment, the periodicity between lines (a printing strobe, for example) is modified based on the relative change RAITE as obtained in the fourth embodiment. If the base repetition period of printing (the repetition period with no compensation) is described by SC, the compensated strobe period is given:

*SC×RAITE*

Figure 22:
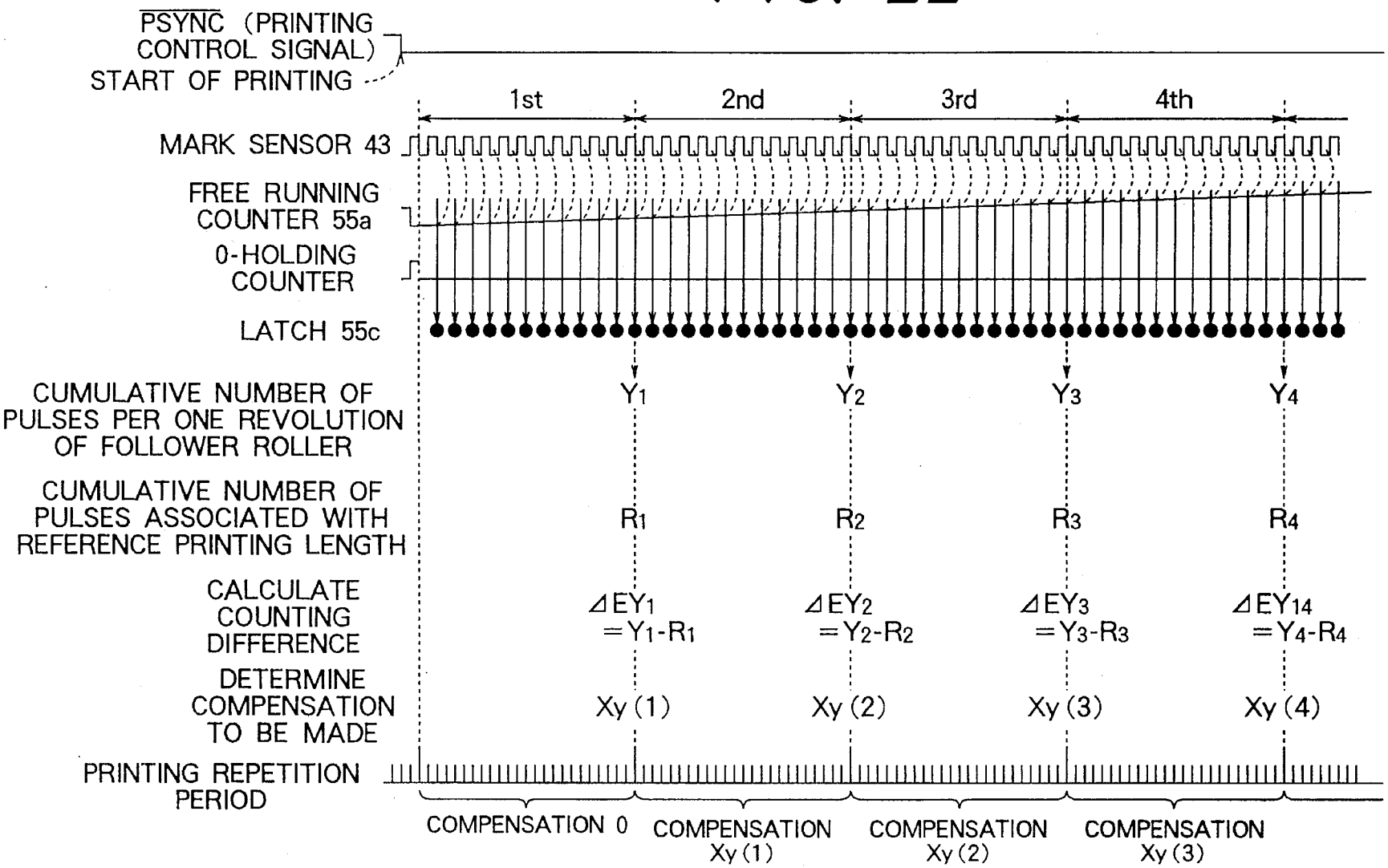
FIG. 22 is a timing chart of the process accordance with a ninth embodiment of the present invention.
Figure 23:
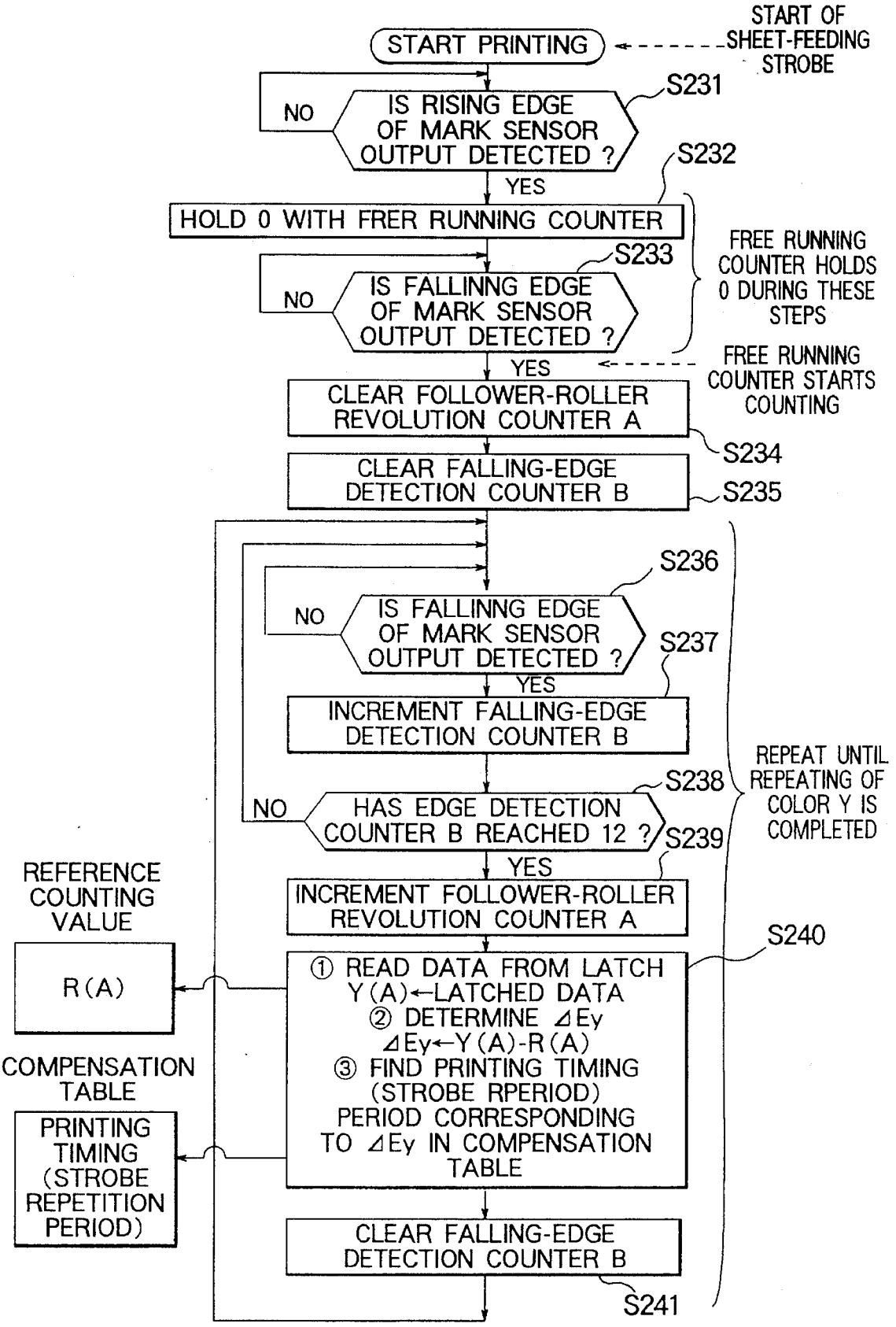
FIG. 23 is a flow chart or the process accordance with the ninth embodiment of the present invention.

A method for realizing the compensation algorithm mentioned above with the configuration shown in FIG. 9 will be described below with reference to the signal timing chart in FIG. 22 and the process flow chart in FIG. 23. In this example, it will be assumed that the disk 42 has twelve marks.

(1) Printing starts. That is to say, the driving motor 11 is made to operate to feed a sheet and the thermal head 9 performs printing. At this stage, the repetition period of the driving pulses is kept constant without performing compensation of the feeding amount of the sheet.

(2) CPU 56*a* monitors the outputs of the mark sensor 43. When the CPU 56*a* detects a rising edge of the output, the CPU 56*a* makes the O-holding counter controller 55*b* control the counter 55*a* so that the counter 55*a* holds 0 (step S231, S232).

(3) Printing is continued. When the CPU 56*a* detects a falling edge of the output of the mark sensor 43, the CPU 56*a* clears the built-in counter A used for counting the number of the revolutions of the follower roller. At this stage, when an falling edge of the output of the mark sensor 43 is detected, the O-holding counter controller 55*b* makes the free running counter 55*a* free from the O-holding operation (steps S233 and S234).

(4) Then, the edge detecting counter B used for counting the falling edges of the outputs of the mark sensor 43 is cleared (step S235).

(5) The edge detecting counter B is incremented each time a falling edge of the output of the marks sensor 43 is detected (steps S236 and S237).

(6) When the counter B counts twelve, the CPU 56*a* increments the revolution counter A and the CPU 56*a* reads data from the latch 55*c*. Using the counting value previously stored when printing is performed and also using the counting value read from the latch at this time, the CPU 56*a* determines RAITE and the compensated repetition period of printing (strobe period). According to these results, the CPU 56*a* controls the feeding amount of the sheet. (steps S238–S240)

(7) The edge detecting counter B is cleared (step S241).

(8) The sequence (5)–(7) is repeated until printing is completed.

in the above description, the calculation is performed in real time to determine the repetition period of printing. However, if the enough calculation time is not available because of the limitation of the processing capability of the CPU 56*a* or other reasons, the possible solution to this problem is to prepare a table which provides the compensated repetition periods of printing calculated for each parameter such as $m_1$ (or $c_1$, $b_1$) and $\Delta E\ m_2$ (or $\Delta E\ c_2$, $\Delta E\ b_2$).

When $m_1$ (or $c_1$, $b_1$) is extremely small compared to $\Delta E\ m_2$ (or $\Delta E\ c_2$, $\Delta E\ b_2$), it becomes possible to prepare the table in which one value of the repetition period of printing corresponds to each value of $\Delta E\ m_2$ (or $\Delta E\ c_2$, $b_2$). In this case, it is possible to achieve the great reduction in the amount of data to be stored in the table. The compensation error introduced by approximating the compensated value by one value will be detected as a counting difference in the following revolution and this error will be compensated at that time. FIG. 19 shows an example of such a table.

Now, a tenth embodiment will be described hereinbelow. In this embodiment, the compensation is made by using driving pulses in stead of the reference pulses which are used in the arrangement as in the sixth and eighth embodiments.

Figure 24:
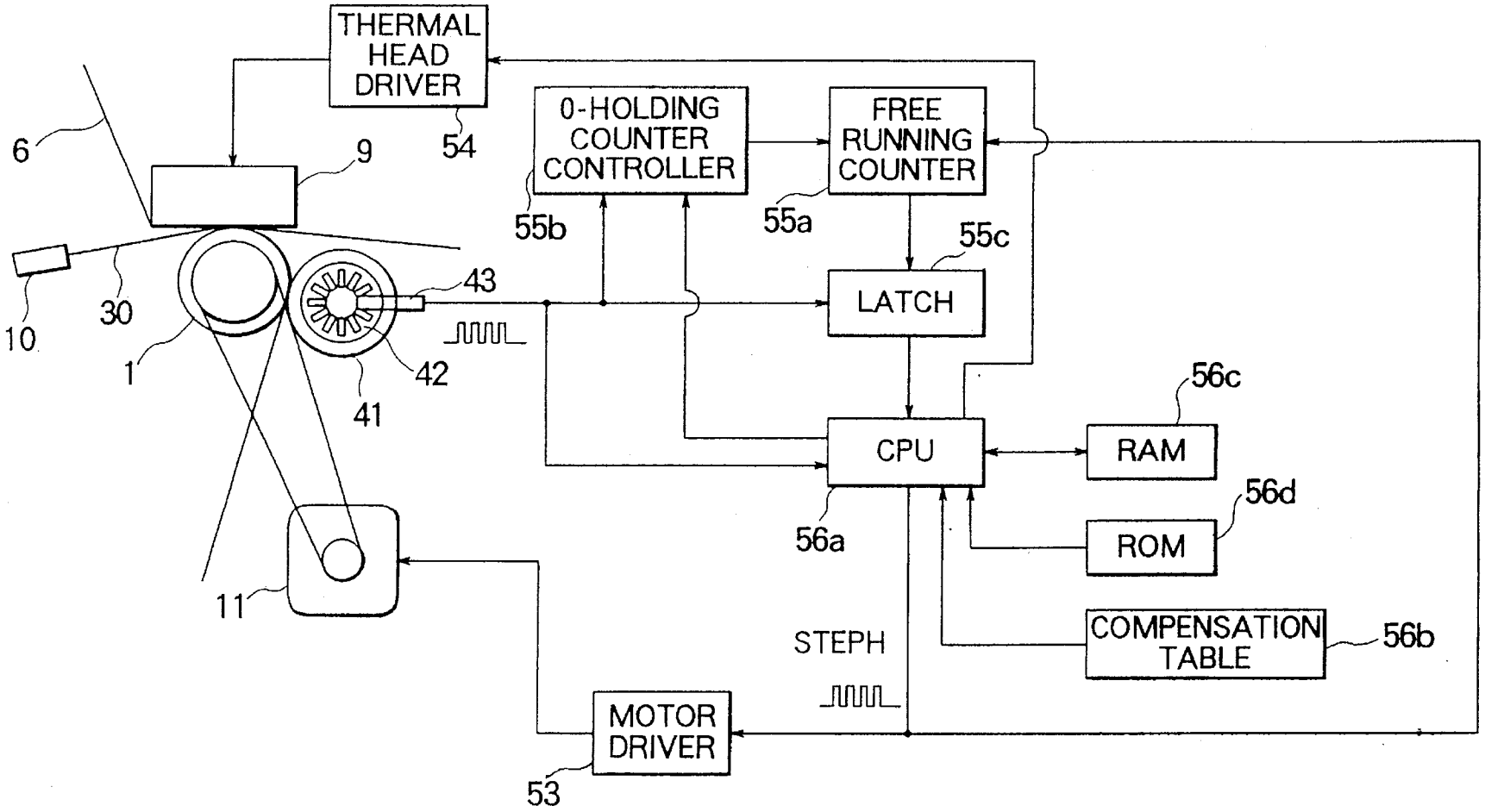
FIG. 24 shows the configuration of a tenth embodiment in accordance with the present invention, in which only main parts are shown.

FIG. 24 shows an arrangement in which in stead of the reference pulses the driving pulses are applied to a free running counter 55*a*. Therefore, the reference clock is not used in this arrangement. The repetition period of the driving pulses is modified based on the requirement of compensation, therefore it is impossible to use the counting value of the free running counter 55*a* for compensation. The counting value of the free running counter 55*a* is converted to the value corresponding to the value which would be counted by the reference clock, by using a method which will be described below.

Each variable will be defined as follows:

The counting number of the follower roller 41 per one revolution (when the driving pulses are used as the input):

1st revolution 2nd revolution 3rd revolution . . . nth revolution

| 1st revolution | 2nd revolution | 3rd revolution | . . . | nth revolution |
|---|---|---|---|---|
| $s_1$ | $s_2$ | $s_3$ | | $s_n$ |

The counting number of the follower roller 41 per one revolution which would be obtained if the reference clock were input:

1st revolution 2nd revolution 3rd revolution . . . nth revolution

| 1st revolution | 2nd revolution | 3rd revolution | . . . | nth revolution |
|---|---|---|---|---|
| $e_1$ | $e_2$ | $e_3$ | | $e_n$ |

The cumulative number of the execution of compensation at the time when the CPU detects each one revolution of the follower roller 41;

1st revolution 2nd revolution 3rd revolution . . . nth revolution

| 1st revolution | 2nd revolution | 3rd revolution | . . . | nth revolution |
|---|---|---|---|---|
| $h_1$ | $h_2$ | $h_3$ | | $h_n$ |

The counting number of tha driving pulse of the follower roller 41 per one revolution (compensated):

1st revolution 2nd revolution 3rd revolution . . . nth revolution

| 1st revolution | 2nd revolution | 3rd revolution | . . . | nth revolution |
|---|---|---|---|---|
| $z_1$ | $z_2$ | $z_3$ | | $z_n$ |

Thus, the following equations are obtained:

$$e_1=s_1-(z_1-w)\cdot h_1/w$$

$$e_2=s_2-s_1-(z_2-w)\cdot(h_2-h_1)/w$$

$$e_3=s_3-s_2-(z_3-w)\cdot(h_3-h_2)/w$$

. . .

$$e_2s_{2-1}-(z_2-w)\cdot(h_2-h_{2-1})/w$$

where w is the repetition period of the driving pulses which will be obtained when no compensation is made, and this repetition period is used as the reference value.

In this embodiment, a calculation unit is provided which performs the calculation based on the algorithm described above. Thus, it is possible to achieve the desired compensation without using a reference clock.

In each embodiment described above, the sheet feeding apparatus is used for printing. However, the apparatus may also be used in other applications in which it is required to monitor the feeding amount of a sheet or to make a warning sound depending on the deviation of the feeding amount.

What is claimed is:

1. A sheet feeding apparatus comprising:

sheet feeding means being rotatable for feeding a sheet;

follower roller means being in contact with said sheet fed by said sheet feeding means for detecting a feeding amount of said sheet, said follower roller means being rotated in accordance with movement of said sheet;

sensor means generating a signal each time said follower roller means rotates by a predetermined angle;

timing deviation detecting means for detecting a deviation in the output timing of an output signal of said sensor means relative to a reference value; and feeding amount deviation calculating means for periodically calculating a deviation in the amount of feeding of said sheet relative to a reference feeding amount based on said deviation in the output timing of the sensor output signal each time said follower roller means rotates a predetermined angle of rotation.

2. The sheet feeding apparatus according to claim 1, wherein the deviation of the feeding amount of said sheet relative to the reference feeding amount is calculated every n revolutions of said follower roller means, said being a natural number.

3. The sheet feeding apparatus according to claim 1, further comprising means for adjusting a starting point of said follower roller means each time a sheet is supplied to said sheet.

4. The sheet feeding apparatus according to claim 1, wherein said follower roller means comprises a plurality of follower rollers having a common axis of rotation, and wherein said sensor means comprises a plurality of sensors provided one for each of said follower rollers for generating a signal each time a corresponding one of said follower rollers rotates a predetermined angle.

5. The sheet feeding apparatus according to claim 1, comprising control means for controlling said sheet feeding means based on the information on the deviation of the feeding amount of said sheet relative to the reference feeding amount to compensate for the feeding amount of said sheet in such a manner that each of printing lengths of colors M, C, and BK is adjusted to a printing length of color Y.

6. A sheet feeding apparatus according to claim 1, further comprising control means for controlling said sheet feeding means based on the information on the deviation of the feeding amount of said sheet relative to the reference value to compensate for the feeding amount of said sheet in such a manner that the printing length of each color is adjusted to a reference printing length.

7. A sheet feeding apparatus according to claim 1, further comprising means for controlling a printing strobe generation means based on the information on the deviation of the feeding amount of said sheet relative to the reference value to control the printing timing in such a manner that each of the printing lengths of colors M, C, and BK is adjusted to a printing length of color Y.

8. A sheet feeding apparatus according to claim 1, further comprising means for controlling a printing strobe generation means based on the information on the deviation of the feeding amount of said sheet relative to the reference value to control the printing timing in such a manner that the printing length of each color is adjusted to a reference printing length.

9. The sheet feeding apparatus according to claim 1, further comprising means for determining the deviation of the feeding amount of said sheet relative to the reference feeding amount by using a reference clock.

10. The sheet feeding apparatus according to claim 1, further comprising means for determining the deviation of the feeding amount of said sheet relative to the reference feeding amount using motor driving pulses.

11. The sheet feeding apparatus according to claim 1, wherein said follower roller means comprises a plurality of follower rollers having a common axis of rotation, wherein said sensor means comprises a plurality of sensors provided one for each of said follower rollers for generating a signal each time a corresponding one of said follower rollers rotates a predetermined angle, and wherein said follower roller means and said sheet feeding means are disposed proximate to one another so as to permit simultaneous contact by said follower roller means and said sheet feeder means with a common region of said sheet.

* * * * *